US010870183B2

(12) United States Patent
Shinozaki

(10) Patent No.: US 10,870,183 B2
(45) Date of Patent: Dec. 22, 2020

(54) SUBSTRATE PROCESSING APPARATUS

(71) Applicant: Ebara Corporation, Tokyo (JP)

(72) Inventor: Hiroyuki Shinozaki, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 833 days.

(21) Appl. No.: 15/471,023

(22) Filed: Mar. 28, 2017

(65) Prior Publication Data

US 2017/0284579 A1 Oct. 5, 2017

(30) Foreign Application Priority Data

Mar. 30, 2016 (JP) ..... 2016-067067

(51) Int. Cl.
*F16L 27/087* (2006.01)
*B24B 57/02* (2006.01)
*F16L 55/00* (2006.01)

(52) U.S. Cl.
CPC ..... *B24B 57/02* (2013.01)

(58) Field of Classification Search
None
See application file for complete search history.

(56) References Cited

U.S. PATENT DOCUMENTS 4,194,767 A * 3/1980 McCracken ..... F16L 39/04 285/121.2
5,080,401 A * 1/1992 Stich ..... F16L 27/087 285/190
5,199,748 A * 4/1993 Jung ..... B23Q 11/103 285/121.4
5,498,163 A * 3/1996 Takamura ..... B25J 19/0029 439/13
6,029,695 A * 2/2000 Logan ..... F16L 27/0828 137/580

(Continued)

FOREIGN PATENT DOCUMENTS

JP 2941786 B1 8/1999
JP 2003042306 A * 2/2003 ..... F16L 39/04

(Continued)

OTHER PUBLICATIONS

Machine Generated English Translation of JP2006-128582A. Published May 2006. (Year: 2006).*

(Continued)

*Primary Examiner* — Sylvia MacArthur
(74) *Attorney, Agent, or Firm* — Abelman, Frayne & Schwab

(57) ABSTRACT

Provided is a substrate processing apparatus that includes: a rotary joint including a rotary unit that rotates together with the rotation of the head unit, a fixing unit that is provided around the rotary unit, and a sealing unit that seals a gap between the rotary unit and the fixing unit; and an outlet pipe through which the quenching water is discharged. A first flow passage through which a gas passes and a second flow passage through which the quenching water passes are formed in the rotary joint, and the second flow passage is isolated from the first flow passage by the sealing unit. One end of the outlet pipe communicates with an outlet port of the second flow passage of the rotary joint, and the other end of the outlet pipe is opened to atmosphere at a position lower than the outlet port of the second flow passage.

15 Claims, 16 Drawing Sheets

(56) References Cited

U.S. PATENT DOCUMENTS

| | | | | |
|---|---|---|---|---|
| 6,412,822 | B1 * | 7/2002 | Omiya | F16L 27/0828 277/937 |
| 2008/0061514 | A1 * | 3/2008 | Suzuki | F16J 15/3484 277/375 |
| 2008/0194189 | A1 * | 8/2008 | Seo | B24B 37/04 451/446 |
| 2011/0049870 | A1 * | 3/2011 | Takahashi | F16J 15/3404 285/282 |
| 2016/0258564 | A1 * | 9/2016 | Fukumoto | F16J 15/34 |
| 2017/0051857 | A1 * | 2/2017 | Sakakura | F16J 15/34 |
| 2017/0074445 | A1 * | 3/2017 | Kikuyama | F16L 39/04 |
| 2017/0284579 | A1 * | 10/2017 | Shinozaki | B24B 57/02 |

FOREIGN PATENT DOCUMENTS

| | | | | |
|---|---|---|---|---|
| JP | 2006128582 | A | * | 5/2006 |
| JP | 2015-193068 | A | | 11/2015 |

OTHER PUBLICATIONS

Machine Generated English Translation of JP2003-042306A. Published Feb. 2003. (Year: 2003).*

Machine Generated English Translation of description of JP 2003-042306. Published Feb. 13, 2003. (Year: 2003).*

Machine Generated English Translation of claims of JP 2003-042306. Published Feb. 13, 2003. (Year: 2003).*

* cited by examiner

SUBSTRATE PROCESSING APPARATUS

CROSS-REFERENCE TO RELATED APPLICATIONS

This application is based on and claims priority from Japanese Patent Application No. 2016-067067, filed on Mar. 30, 2016, with the Japan Patent Office, the disclosure of which is incorporated herein in its entirety by reference.

TECHNICAL FIELD

The present disclosure relates to a substrate processing apparatus.

BACKGROUND

In the related art, a substrate processing apparatus which performs a processing on a substrate such as, for example, a polishing apparatus, an etcher, or a chemical vapor deposition (CVD) apparatus, has been known. For example, in a polishing apparatus of the related art, a rotary joint is disposed on a flow passage which supplies a gas at the time of adsorbing a wafer or pressing the wafer against a polishing pad or sucks out a gas from a space formed by an elastic film of a head unit (also referred to as a "top ring") (see, e.g., Japanese Laid-Open Patent Publication No. 2015-193068). The rotary joint has a rotary unit which rotates together with rotation of the head unit and a fixing unit provided around the rotary unit, and provides a function of forming a main line (also referred to as a "first flow passage") which communicates a flow passage formed in the rotary unit with a flow passage formed by the fixing unit.

The rotary joint is provided with a sealing unit to seal a gap between the rotary unit and the fixing unit. The sealing unit is a mechanical seal, and silicon carbide (SiC) or a carbon material is used as a material for the sealing unit. The rotary unit slides on the fixing unit so that heat is generated on a contact surface between the rotary unit and the fixing unit. Due to the thermal expansion caused by the generated heat, a change in a shape of the rotary unit or the fixing unit and/or a change in a contact pressure between the rotary unit and the fixing unit is generated, which causes the lowering of the sealing performance Therefore, in order to reduce the heat, a quenching water line (also referred to as a "second flow passage") is provided to circulate water through the outside in a circumferential direction of the mechanical seal. Here, the water uses for water circulation is referred to as quenching water. Further, a drain line (also referred to as a "drain flow passage") is provided in the outside of the quenching water line to discharge the quenching water that has leaked to the outside in an axial direction of the rotary joint.

SUMMARY

According to a first aspect of the present disclosure, a substrate processing apparatus includes: a rotary joint including a rotary unit that rotates together with the rotation of the head unit, a fixing unit that is provided around the rotary unit, and a sealing unit that seals a gap between the rotary unit and the fixing unit, in which a first flow passage through which a gas passes and a second flow passage through which the quenching water passes are formed in the rotary joint, and the second flow passage is isolated from the first flow passage by the sealing unit; and an outlet pipe through which the quenching water is discharged, in which one end of the outlet pipe communicates with an outlet port of the second flow passage of the rotary joint, and the other end of the outlet pipe is opened to atmosphere at a position lower than the outlet port of the second flow passage.

The foregoing summary is illustrative only and is not intended to be in any way limiting. In addition to the illustrative aspects, embodiments, and the features described above, further aspects, embodiments, and features will become apparent by reference to the drawings and the following detailed description.

DETAILED DESCRIPTION

Figure 1:
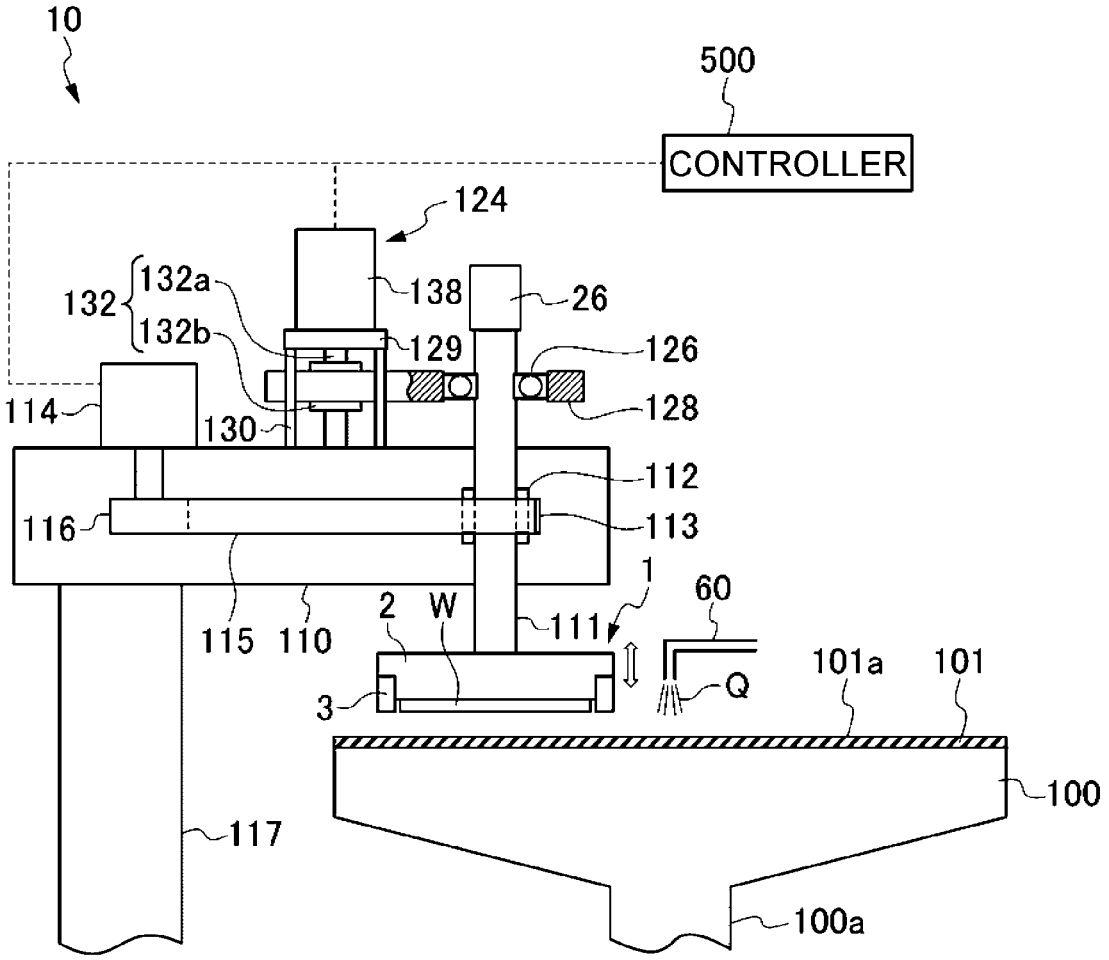
FIG. 1 is a schematic view illustrating an overall configuration of a polishing apparatus which is common to respective exemplary embodiments.

In the following detailed description, reference will be made to the accompanying drawings, which form a part hereof. The exemplary embodiments described in the detailed description, drawings, and claims are not meant to be limiting. Other embodiments may be utilized, and other changes may be made without departing from the spirit or scope of the subject matter presented here.

When the quenching water leaks to the main line (first flow passage), the wafer may not be pressed with a desired pressure. Thus, it is required to prevent the leakage of the quenching water to the main line (first flow passage). Specifically, when a supply pressure of the quenching water to the rotary joint is increased, the quenching water in the rotary joint may easily leak to the main line (the first flow passage). Therefore, there is a demand for lowering the supply pressure of the quenching water. Further, since it is required to continuously drive the substrate processing apparatus, there is a demand for securing a flow rate of water in the quenching water line (the second flow passage). As described above, it is required to secure the flow rate of the quenching water line (the second flow passage) of the rotary joint while preventing the leakage of the quenching water to the main line (the first flow passage) in the rotary joint.

In consideration of the problems described above, the present disclosure provides a substrate processing apparatus which is capable of securing a flow rate of a quenching water line (second flow passage) of a rotary joint while suppressing a possibility of leakage of the quenching water to the main line (first flow passage) in the rotary joint.

According to a first aspect of the present disclosure, a substrate processing apparatus includes: a rotary joint including a rotary unit that rotates together with the rotation of the head unit, a fixing unit that is provided around the rotary unit, and a sealing unit that seals a gap between the rotary unit and the fixing unit, in which a first flow passage through which a gas passes and a second flow passage through which the quenching water passes are formed in the rotary joint, and the second flow passage is isolated from the first flow passage by the sealing unit; and an outlet pipe through which the quenching water is discharged, in which one end of the outlet pipe communicates with an outlet port of the second flow passage of the rotary joint, and the other end of the outlet pipe is opened to atmosphere at a position lower than the outlet port of the second flow passage.

According to this configuration, in the outlet port of the second flow passage of the rotary joint, water is filled between the outlet port of the second flow passage of the rotary joint and the other end of the outlet pipe which is opened to the atmosphere so that a hydraulic head pressure corresponding to the height difference is applied downwardly to the other end of the outlet pipe. Therefore, in the other end of the outlet pipe, the quenching water is sucked out with the hydraulic head pressure corresponding to the height difference. Thus, the pressure of the outlet port of the second flow passage becomes lower than the pressure of the other end of the outlet pipe (i.e., the atmospheric pressure) by the hydraulic head pressure corresponding to the height difference so that the pressure of the second flow passage may be lower than the atmospheric pressure. Therefore, since the pressure of the second flow passage is lower than the pressure of the first flow passage, the pressure difference acts to maintain the quenching water in the second flow passage. Thus, the possibility of leakage of the quenching water from the second flow passage to the first flow passage through the sealing unit may be lowered. Further, the quenching water is sucked out from the outlet port so that even if the supply pressure of the quenching water toward the rotary joint is lowered, the flow rate of the quenching water line (second flow passage) of the rotary joint may be secured. As described above, since the supply pressure of the quenching water toward the rotary joint may be reduced, the possibility of leakage to the first flow passage in the rotary joint may also be suppressed in this point of view. Accordingly, it is possible to secure the flow rate of the second flow passage to the rotary joint while suppressing the possibility of leakage to the first flow passage in the rotary joint.

According to a second aspect of the present disclosure, the substrate processing apparatus according to the first aspect further includes: a branch pipe having an inlet port through which the quenching water is supplied and divided into a first branch portion and a second branch portion. An end of the first branch portion communicates with an inlet port of the second flow passage of the rotary joint and an opening of the second branch portion is opened to the atmosphere at a position higher than the inlet port of the second flow passage.

According to this configuration, the water surface in the second branch portion may rise to the opening of the second branch portion. Even if the supply pressure of the quenching water from the inlet port rises to exceed a pressure corresponding to the height difference, the quenching water overflows from the opening of the second branch portion so that the water surface becomes constant. Further, the pressure at the inlet port of the second flow passage is maintained at a pressure corresponding to the height difference. In this way, the pressure at the inlet port of the second flow passage is limited to the pressure corresponding to the height difference. It is possible to suppress the supply pressure of the quenching water to the pressure corresponding to the height difference of the opening of the second branch portion and the inlet port of the second flow passage.

According to a third aspect of the present disclosure, in the substrate processing apparatus according to the second aspect, the second branch portion extends in a direction lower than the inlet port of the second flow passage and then upwardly extends, and the opening of the second branch portion is opened to the atmosphere.

According to this configuration, even if the supply pressure of the deionized water from the inlet port of the branch pipe BP is lower than the suction pressure, the second branch portion extends in the direction lower than the inlet port of the second flow passage. Therefore, the liquid surface may be maintained in a position lower than the inlet port T1 of the second flow passage. Thus, it is possible to prevent the air from being sucked to the second flow passage of the rotary joint.

According to a fourth aspect of the present disclosure, in the substrate processing apparatus according to the third aspect, the height difference from the outlet port of the second flow passage of the rotary joint to the opening of the outlet pipe and the pressure of the quenching water flowing into the branch pipe are adjusted such that a height of a liquid surface of the quenching water in the second branch portion is maintained to be lower than the inlet port of the second flow passage regardless of a predetermined pressure fluctuation.

According to this configuration, since the second flow passage of the rotary joint has always a negative pressure as compared to the atmospheric pressure, the second flow passage has always a negative pressure as compared to that in the first flow passage. Therefore, the pressure difference always acts in such a manner that the quenching water is maintained in the second flow passage. Thus, it is possible to prevent the quenching water from leaking from the second flow passage to the first flow passage through the sealing unit.

According to a fifth aspect of the present disclosure, in the substrate processing apparatus according to any one of the second to fourth aspects, the height difference between the opening of the second branch portion and the inlet port of the second flow passage is determined based on a limit pressure that limits the pressure of the quenching water supplied to the second flow passage.

According to this configuration, it is possible to suppress the pressure of the quenching water supplied to the second flow passage to be equal to or lower than the limit pressure.

According to a sixth aspect of the present disclosure, in the substrate processing apparatus according to any one of the second to fifth aspects, the second branch portion has transparency.

According to this configuration, the position of the liquid surface in the pipe of the second branch portion can be identified so that the current pressure of the quenching water can be visually noticed.

According to a seventh aspect of the present disclosure, the substrate processing apparatus according to any one of the second to sixth aspects may further include a drain board disposed to receive the quenching water leaking from the opening of the second branch portion, and having an outlet port that discharges the received quenching water.

According to this configuration, the leaking quenching water can be discharged to a desired discharging place.

According to an eighth aspect of the present disclosure, in the substrate processing apparatus according to any one of the first to seventh aspects, the height difference between the outlet port of the second flow passage of the rotary joint and the other end of the outlet pipe is determined based on a suction pressure of the quenching water.

According to this configuration, the quenching water can be sucked out from the rotary joint at a desired suction pressure.

According to a ninth aspect of the present disclosure, the substrate processing apparatus according to any one of the second to sixth aspects further includes: a drain board disposed to receive the quenching water leaking from the opening of the second branch portion and having an outlet port that discharges the received quenching water; and a connection pipe one end of which communicates with the outlet port of the drain board and the other end communicates with the outlet pipe. The height of the outlet port of the drain board is determined based on the suction pressure of the quenching water.

According to this configuration, the quenching water leaking from the opening of the second branch portion can be discharged together with the normally discharged quenching water. Further, the quenching water can be sucked out at a desired suction pressure.

According to a tenth aspect of the present disclosure, in the substrate processing apparatus according to the ninth aspect, the rotary joint further includes a second sealing unit that seals a gap between the quenching water and the atmosphere and a drain flow passage isolated from the second flow passage and having an outlet port opened to the atmosphere is formed by the second sealing unit, and the drain board is also disposed to receive the quenching water leaking from the outlet port of the drain flow passage.

According to this configuration, the quenching water leaking from the second sealing unit can be discharged together with the normally discharged quenching water.

According to an eleventh aspect of the present disclosure, in the substrate processing apparatus according to any one of the first to sixth aspects, the rotary joint further includes the rotary joint further includes a second sealing unit that seals a between the quenching water and the atmosphere and a drain flow passage isolated from the second flow passage and having an outlet port opened to the atmosphere is formed by the second sealing unit. In addition, the substrate processing apparatus further includes: a drain board disposed to receive the quenching water leaking from the opening of the second branch portion and having an outlet port that discharges the received quenching water; and a connection pipe one end of which communicates with the outlet port of the drain board and the other end communicates with the outlet pipe. The height of the outlet port of the drain board is determined based on the suction pressure of the quenching water.

According to this configuration, the quenching water leaking from the second sealing unit can be discharged together with the normally discharged quenching water. Further, the quenching water can be sucked out at a desired suction pressure.

According to a twelfth aspect of the present disclosure, a substrate processing apparatus includes: a rotary joint including a rotary unit that rotates together with the rotation of the head unit, a fixing unit that is provided around the rotary unit, and a sealing unit that seals a gap between the rotary unit and the fixing unit, in which a first flow passage through which a gas passes and a second flow passage through which the quenching water passes are formed in the rotary joint, and the second flow passage is isolated from the first flow passage by the sealing; and a branch pipe having an inlet port through which the quenching water is supplied and divided into a first branch portion and a second branch portion, in which an end of the first branch portion communicates with an inlet port of the second flow passage of the rotary joint and an opening of the second branch portion is opened to the atmosphere at a position higher than the inlet port of the second flow passage.

According to this configuration, a water surface in the second branch portion may rise to the opening of the second branch portion. Even if the supply pressure of the quenching water from the inlet port rises to exceed a pressure corresponding to the difference in heights, the quenching water overflows from the opening of the second branch portion so that the water surface becomes constant, and the pressure at the inlet port of the second flow passage is maintained at a pressure corresponding to the height difference H. As described above, the pressure at the inlet port of the second flow passage FP2 is limited to the pressure corresponding to the difference of heights. The supply pressure of the quenching water may be suppressed to the pressure corresponding to the height difference between the opening of the second branch portion and the inlet port of the second flow passage.

According to a thirteenth aspect of the present disclosure, in the substrate processing apparatus according to the twelfth aspect, the height difference between the opening of the second branch portion and the inlet port of the second flow passage is determined based on a limit pressure that is limited when the quenching water is supplied.

According to this configuration, it is possible to suppress the pressure of the quenching water supplied to the second flow passage to be equal to or lower than the limit pressure.

According to a fourteenth aspect of the present disclosure, in the substrate processing apparatus according to the twelfth or thirteenth aspect, the second branch portion extends in a direction higher than the inlet port of the second flow passage and then downwardly extends.

According to this configuration, it is possible to prevent the quenching water being upwardly sucked out.

According to a fifteenth aspect of the present disclosure, in the substrate processing apparatus according to the fourteenth aspect, a height difference between the highest position of the second branch portion and the inlet port of the second flow passage is determined based on an allowable pressure that is allowed to the quenching water supplied to the second flow passage, and a height difference between the opening of the second branch portion and the inlet port of the second flow passage is determined based on the limit pressure maintained when the pressure of the quenching water exceeds the allowable pressure.

According to this configuration, the pressure of the quenching water is normally suppressed to be equal to or lower than the allowable pressure, and when the pressure of the quenching water exceeds the allowable pressure, the pressure of the quenching water is maintained at the limit pressure.

According to the present disclosure, in the outlet port of the second flow passage of the rotary joint, water is filled between the outlet port of the second flow passage of the rotary joint and the other end of the outlet pipe which is opened to the atmosphere so that a hydraulic head pressure corresponding to the height difference is applied downwardly to the other end of the outlet pipe. Therefore, in the other end of the outlet pipe, the quenching water is sucked out at the hydraulic head pressure corresponding to the height difference. Thus, since the pressure of the outlet port of the second flow passage becomes lower than the pressure (i.e., the atmospheric pressure) of the other end of the outlet pipe by the hydraulic head pressure corresponding to the difference of the heights, the pressure of the second flow passage may be lower than an atmospheric pressure. Therefore, since the pressure of the second flow passage is lower than the pressure of the first flow passage, the pressure difference acts such that the quenching water is maintained in the second flow passage. Consequently, it is possible to prevent the quenching water from leaking from the second flow passage to the first flow passage through the sealing unit.

Since the quenching water is sucked out from the outlet port, it is possible to secure the flow rate of the quenching water line (second flow passage) of the rotary joint even if the supply pressure of the quenching water to the rotary joint is lowered. In this way, since the supply pressure of the quenching water toward the rotary joint can be reduced, the possibility of leakage to the first flow passage in the rotary joint can be also suppressed in this point of view. Accordingly, it is possible to secure the flow rate of the second flow passage to the rotary joint while suppressing the possibility of leakage to the first flow passage in the rotary joint.

Hereinafter, exemplary embodiments of the present disclosure (hereinafter, referred to as "exemplary embodiments") will be described with reference to the accompanying drawings. A substrate processing apparatus refers to an apparatus that performs a processing on a substrate and includes, for example, a polishing apparatus, an etcher, and a apparatus. Each exemplary embodiment will be described using a polishing apparatus as an example of the substrate processing apparatus. However, the exemplary embodiments to be described below are examples when the present disclosure is carried out, and the present disclosure is not limited to a specific configuration to be described below. In order to carry out the present disclosure, a specific configuration according to an exemplary embodiment may be appropriately employed.

First Exemplary Embodiment

FIG. 1 is a schematic view illustrating an overall configuration of a polishing apparatus which is common to respective exemplary embodiments. As illustrated in FIG. 1, a polishing apparatus 10 includes a polishing table 100 and a head unit (hereinafter, referred to as a "top ring") 1 as a substrate holding device that holds a substrate such as, for example, a semiconductor wafer to be polished, in order to press the substrate against a polishing surface on the polishing table 100. The polishing table 100 is connected to a motor (not illustrated) disposed below the polishing table through a table shaft 100*a*. The polishing table 100 rotates around the table shaft 100*a* when the motor rotates. A polishing pad 101 serving as a polishing member is attached to the top surface of the polishing table 100. A surface of the polishing pad 101 constitutes a polishing surface 101*a* that polishes the semiconductor wafer W. A polishing liquid supplying nozzle 60 is provided above the polishing table 100. The polishing liquid (polishing slurry) Q is supplied onto the polishing pad 101 on the polishing table 100 from the polishing liquid supplying nozzle 60.

Meanwhile, various polishing pads are available in the market. For example, SUBA800, IC-1000, and IC-1000/SUBA400 (two layer cloth) manufactured by Nitta Haas Incorporated and Surfin xxx-5 and Surfin 000 manufactured by Fujimi Incorporated are available. SUBA800, Surfin xxx-5, and Surfin 000 are nonwoven fabrics in which fibers are hardened with a urethane resin, and IC-1000 is hard foamed polyurethane (single layer). The foamed polyurethane is porous (porous type) and has a plurality of minute concaves or holes on a surface thereof.

The top ring 1 basically includes a top ring body 2 that presses a semiconductor wafer W against the polishing surface 101*a* and a retainer ring 3 serving as a retainer member that holds the outer peripheral edge of the semiconductor wafer W such that the semiconductor wafer W does not escape from the top ring 1. The top ring 1 is connected to a top ring shaft 111. The top ring shaft 111 vertically moves with respect to a top ring head 110 by a vertical moving mechanism 124. The vertical position of the top ring 1 may be determined by elevating the entire top ring 1 with respect to the top ring head 110 by the vertical movement of the top ring shaft 111. A rotary joint 26 is attached to the top end of the top ring shaft 111.

The vertical moving mechanism 124 which vertically moves the top ring shaft 111 and the top ring 1 includes a bridge 128 configured to rotatably support the top ring shaft 111 through a bearing 126, a ball screw 132 attached to the bridge 128, a support base 129 supported by a support column 130, and a servo motor 138 provided on the support base 129. The support base 129 which supports the servo motor 138 is fixed to the top ring head 110 through the support column 130.

The ball screw 132 includes a screw shaft 132*a* connected to the servo motor 138 and a nut 132*b* to which the screw shaft 132*a* is screwed. The top ring shaft 111 vertically moves integrally with the bridge 128. Accordingly, when the servo motor 138 is driven, the bridge 128 vertically moves through the ball screw 132 and thus the top ring shaft 111 and the top ring 1 vertically move.

The top ring shaft 111 is connected to a rotary cylinder 112 through a key (not illustrated). The rotary cylinder 112 includes a timing pulley 113 on an outer circumferential portion. A top ring rotary motor 114 is fixed to the top ring head 110 and the timing pulley 113 is connected to a timing pulley 116 provided in the top ring rotary motor 114 through the timing belt 115. Therefore, when the top ring rotary motor 114 is rotationally driven, the rotary cylinder 112 and the top ring shaft 111 are integrally rotated through the timing pulley 116, the timing belt 115, and the timing pulley 113, thereby rotating the top ring 1.

The top ring head 110 is supported by the top ring head shaft 117 which is rotatably supported to the frame (not illustrated). The polishing apparatus 10 includes a controller 500 that controls each equipment in the apparatus including the top ring rotary motor 114, the servo motor 138, and the polishing table rotary motor.

Figure 2:
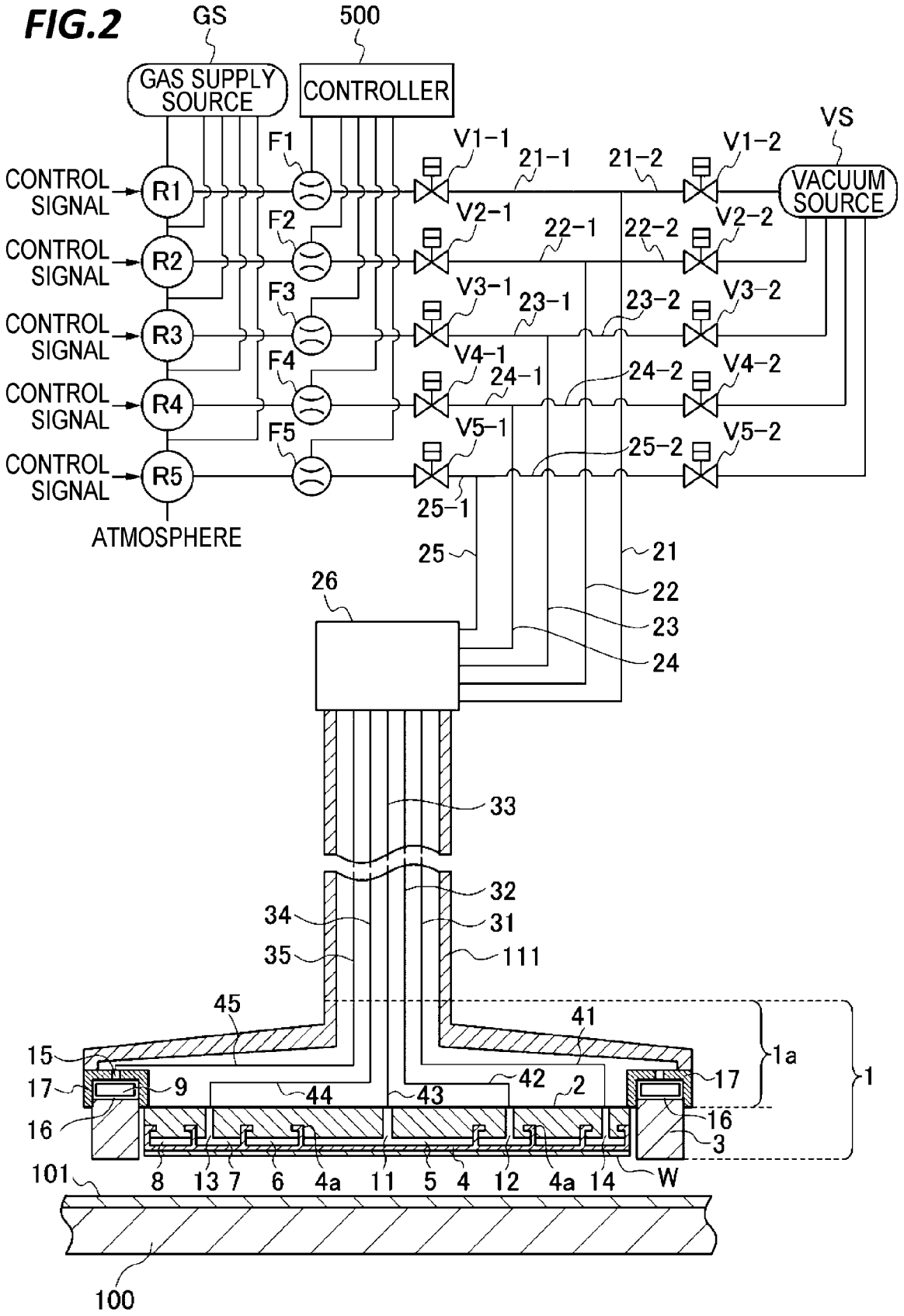
FIG. 2 is a schematic cross-sectional view of a top ring according to a first exemplary embodiment.

Next, the top ring 1 in the polishing apparatus according to the exemplary embodiment will be described. The top ring 1 holds a semiconductor wafer to be polished and presses the semiconductor wafer against the polishing surface on the polishing table 100. FIG. 2 is a schematic cross-sectional view of a top ring according to a first exemplary embodiment. FIG. 2 only illustrates main components that configure the top ring 1.

As illustrated in FIG. 2, the top ring 1 basically includes a base unit 1*a* connected to the top ring shaft 111, a carrier unit (also referred to as a "top ring body") 2 configured to press a semiconductor wafer W against a polishing surface 101*a*, and a retainer ring 3 serving as a retainer member that directly presses the polishing surface 101*a*. The base unit 1*a* is formed with a plurality of first head flow passages 41 to 45 to supply a gas or form a vacuum. The carrier unit 2 is formed in a substantially disk shaped member, and the retainer ring 3 is attached to the outer circumferential portion of the top ring body 2.

The carrier unit 2 is formed of a resin such as, for example, an engineering plastic (e.g., PEEK). An elastic film (membrane) 4 wafer is attached on the bottom surface of the carrier unit 2 to be is in contact with a rear surface of a semiconductor wafer. The elastic film (membrane) 4 is formed of a rubber material having good strength and durability, such as, for example, ethylene propylene rubber (EPDM), polyurethane rubber, or silicon rubber. The elastic film (membrane) 4 constitutes a substrate holding surface that holds a substrate such as, for example, a semiconductor wafer.

The elastic film (membrane) 4 has a plurality of concentric partitions 4*a*, and a circular center chamber 5, an annular ripple chamber 6, an annular outer chamber 7, and an annular edge chamber 8 are formed between a top surface of the membrane 4 and a bottom surface of the top ring body 2, by the partitions 4*a*. That is, the center chamber 5 is formed at a central part of the top ring body 2, and the ripple chamber 6, the outer chamber 7, and the edge chamber 8 are sequentially and concentrically formed from the center in the outer circumferential direction. The top ring body 2 is formed a second head flow passage 11 which communicates with the center chamber 5, a second head flow passage 12 which communicates with the ripple chamber 6, a second head flow passage 13 which communicates with the outer chamber 7, and a second head flow passage 14 which communicates with the edge chamber 8. As described above, the carrier unit 2 is formed with a plurality of second head flow passages 11 to 15 which communicate with the plurality of first head flow passages 41 to 45.

The second head flow passage 11 which communicates with the center chamber 5 is connected to a pipe 21 through the flow passage 31 in the top ring shaft 111 and the rotary joint 26.

Similarly, the second head flow passage 12 which communicates with the ripple chamber 6 is connected to a pipe 22 through the flow passage 32 in the top ring shaft 111 and the rotary joint 26.

Similarly, the second head flow passage 13 which communicates with the outer chamber 7 is connected to a pipe 23 through the flow passage 33 in the top ring shaft 111 and the rotary joint 26.

Similarly, the second head flow passage 14 which communicates with the edge chamber 8 is connected to a pipe 24 through the flow passage 34 in the top ring shaft 111 and the rotary joint 26.

The pipes 21, 22, 23, and 24 are diverged into first branching sections 21-1, 22-1, 23-1, and 24-1 and second branching sections 21-2, 22-2, 23-2, and 24-2. The first branching sections 21-1, 22-1, 23-1, and 24-1 are connected to a gas supply source through valves V1-1, V2-1, V3-1, and V4-1, flow meters F1, F2, F3, and F4, and pressure control valves R1, R2, R3, and R4, respectively. Here, the pressure control valves R1, R2, R3, and R4 are electropneumatic regulators, as an example. Further, the second branch portions 21-2, 22-2, 23-2, and 24-2 are connected to a vacuum source VS through the valves V1-2, V2-2, V3-2, and V4-2, respectively.

A retainer ring pressure chamber 9 is also formed directly above the retainer ring 3 by an elastic film (membrane) 16. The elastic film (membrane) 16 is accommodated in a cylinder 17 fixed to a flange unit of the top ring 1. The retainer ring pressure chamber 9 is connected to a pipe 25 through the flow passage 15 formed in the carrier unit 2, the flow passage 35 in the top ring shaft 111, and the rotary joint 26. The pipe 25 is diverged into a first branch portion 25-1 and a second branch portion 25-2. The first branch portion 25-1 is connected to a pressure adjusting unit 30 through a valve V5-1, a flow meter F5, and a pressure control valve R5. Here, the pressure control valve R5 is an electropneumatic regulator, as an example. Further, the second branch portion 25-2 is connected to a vacuum source VS through the valve V5-2.

The pressure control valves R1, R2, R3, R4, and R5 have a pressure adjusting function of adjusting a pressure of a pressure fluid (for example, a gas) which is supplied from the gas supply source GS to the center chamber 5, the ripple chamber 6, the outer chamber 7, the edge chamber 8, and the retainer ring pressure chamber 9. The pressure control valves R1, R2, R3, R4, and R5 and the valves V1-1 to V1-2, V2-1 to V2-2, V3-1 to V3-2, V4-1 to V4-2, and V5-1 to V5-2 are connected to the controller 500 so that the operations thereof are controlled. For example, the pressure control valves R1, R2, R3, R4, and R5 operate in accordance with a control signal input by the controller 500. Further, the flow meters F1, F2, F3, F4, and F5 detect flow rates of the gases passing through the first branch portions 21-1, 22-1, 23-1, 24-1, and 25-1, respectively. Each of the flow meters F1, F2, F3, F4, and F5 is connected to the controller 500 and outputs a flow rate signal indicating a detected flow rate of gas to the controller 500.

The pressures of fluids supplied to the center chamber 5, the ripple chamber 6, the outer chamber 7, the edge chamber 8, and the retainer ring pressure chamber 9 are independently adjusted by the pressure control valves R1, R2, R3, R4, and R5. With this configuration, a pressing force to press the semiconductor wafer W against the polishing pad 101 may be adjusted for every region of the semiconductor wafer, and further, the pressing to press the retainer ring 3 against the polishing pad 101 may be adjusted.

Hereinafter, a flow passage related with the pipe 21 will be described as a representative example.

Figure 3:
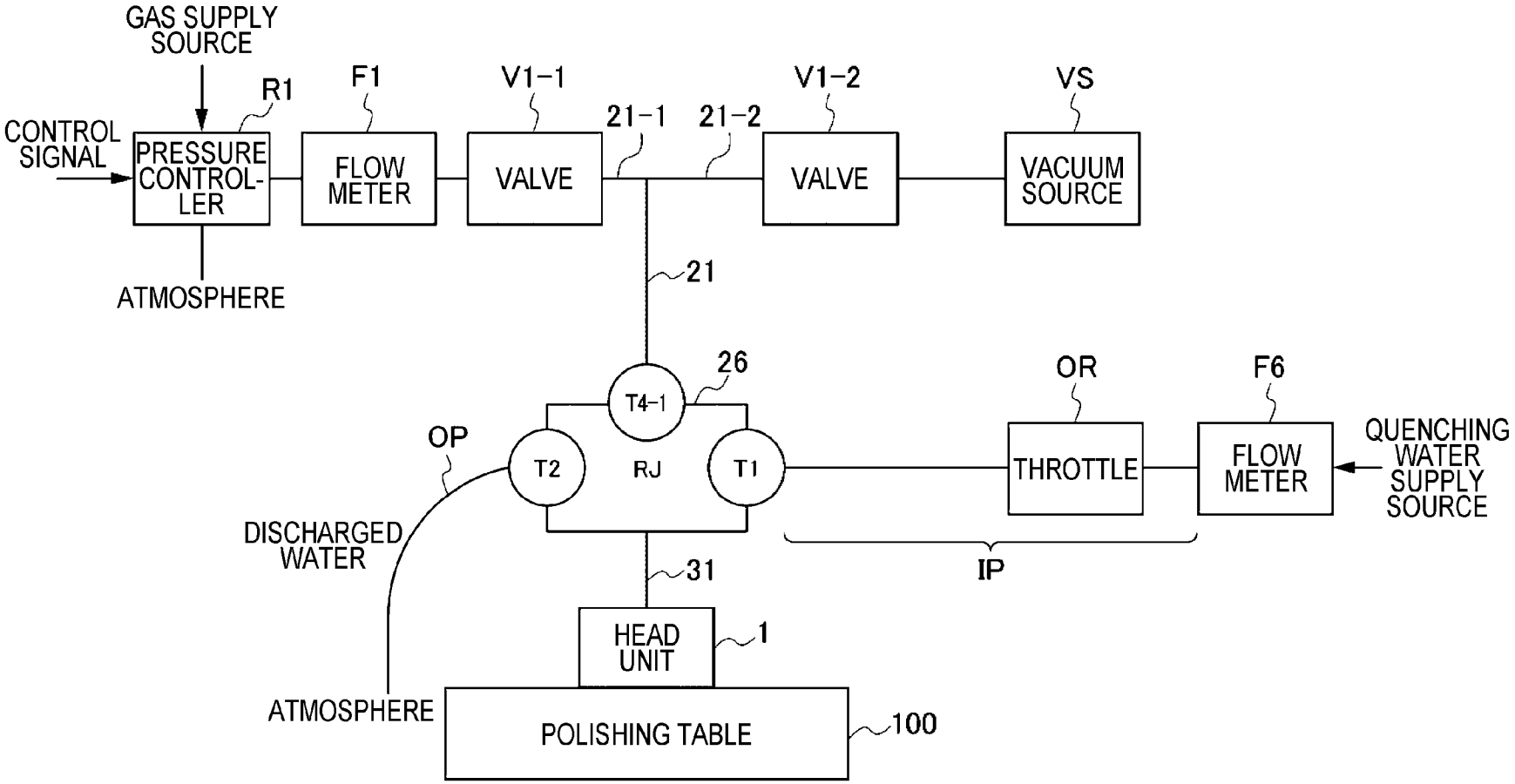
FIG. 3 is a schematic view illustrating a configuration of a part of a polishing apparatus according to a first exemplary embodiment.

FIG. 3 is a schematic view illustrating a configuration of a part of a polishing apparatus 10 according to the first exemplary embodiment. FIG. 3 illustrates a schematic connection relationship only for a flow passage related to the pipe 21. As illustrated in FIG. 3, the polishing apparatus 10 further includes a flow meter F6 which measures a flow rate of a quenching water supplied from a quenching water supply source and an inlet pipe IP which communicates with the flow meter F6 and also communicates with an inlet port T1 of the second flow passage FP2 of the rotary joint 26. Here, in the inlet pipe IP, a throttle (orifice) OR is formed to reduce a flow rate of the quenching water. For example, a deionized water (DIW) diverged from a deionized water (DIW) line (not illustrated) connected to the quenching water supply source and decompressed by a regulator flows into the flow meter F6.

The polishing apparatus 10 includes an outlet pipe OP through which the quenching water is discharged. One end of the outlet pipe OP is connected to an outlet port T2 of the second flow passage FP2 of the rotary joint 26 and the other end (an opening) is opened to the atmosphere at a position lower than the outlet port T2 of the second flow passage FP2.

Figure 4:
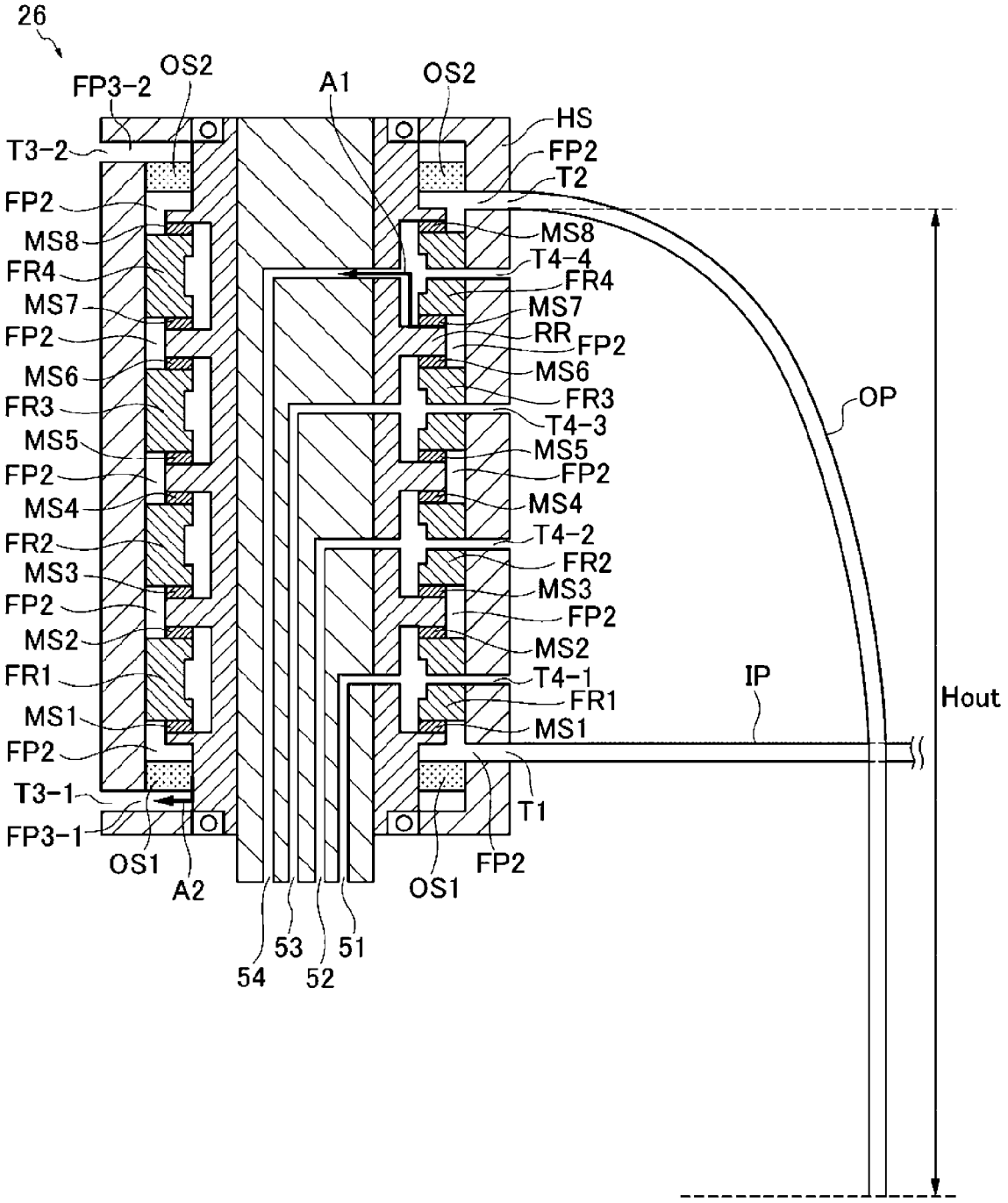
FIG. 4 is a schematic cross-sectional view illustrating an arrangement of an outlet pipe and an inlet pipe according to a first exemplary embodiment.

FIG. 4 is a schematic cross-sectional view illustrating an arrangement of an outlet pipe and an inlet pipe according to the first exemplary embodiment. As illustrated in FIG. 4, the rotary joint 26 has a rotary unit RR which rotates together with the rotation of the head unit (top ring) 1, fixing units FR1, FR2, FR3, FR4, and FR5 provided around the rotary unit RR, and a housing HS to which the fixing units FR1, FR2, FR3, FR4, and FR5 are fixed.

The rotary unit RR has a structure in which a center portion is cylindrical and has irregularities in a circumferential direction. In the rotary unit RR, cavities are formed to be isolated from each other. The fixing units FR1, FR2, FR3, and FR4 have a ring shaped structure with irregularities on an inner circumference side. Holes are formed in the fixing units FR1, FR2, FR3, and FR4 to penetrate the fixing units FR1, FR2, FR3, and FR4 from the inner circumference side to the outer circumference side. One end of each hole communicates with a cavity in the rotary unit RR and the other end thereof communicates with a hole formed in the housing HS. Thus, first flow passages 51, 52, 53, 54, and 55 (the flow passage 55 is not illustrated) are formed in the rotary joint 26.

One ends of the first flow passages 51, 52, 53, 54, and 55 communicate with flow passages 31, 32, 33, 34, and 35 in the top ring shaft 111, respectively. The other ends of the first flow passages 51, 52, 53, 54, and 55 communicate with pipes 21, 22, 23, 24, and 25 through outward ports T4-1, T4-2, T4-3, T4-4, and T4-5, respectively.

The rotary joint 26 includes sealing units MS1 and MS2 which seal a gap between the rotary unit RR and the fixing unit FR1, sealing units MS3 and MS4 which seal a gap between the rotary unit RR and the fixing unit FR2, sealing units MS5 and MS6 which seal a gap between the rotary unit RR and the fixing unit FR3, and sealing units MS7 and MS8 which seal a gap between the rotary unit RR and the fixing unit FR4. The sealing units MS1 to MS8 seal a gap when the rotary unit RR slides with respect to the fixing units FR1 to FR4. The sealing units MS1 to MS8 according to the exemplary embodiment, for example, are mechanical seals and have a ring shaped structure. A second flow passage FP2 is formed to be isolated from the first flow passages 51 to 55 by the sealing units MS1 to MS8. As described above, a plurality of first flow passages having a plurality of sealing units MS1 to MS8 are formed in the rotary joint 26 to be isolated from the second flow passage FP2 by the plurality of sealing units MS1 to MS8. The quenching water is supplied from the inlet port T1 to flow through the second flow passage FP2 and discharged from the outlet port T2. As indicated by an arrow A1 of FIG. 4, when the sealing of the sealing unit MS7 is loosened, the quenching water flowing through the second flow passage FP2 leaks to the first flow passages 51 to 55.

In addition, the rotary joint 26 has second sealing units OS1 and OS2 provided between the housing HS and the rotary unit RR to seal a gap between the quenching water and the atmosphere, and drain flow passages FP3-1 and FP3-2 are formed in the rotary joint 26 to be isolated from the second flow passage FP2 by the second sealing units OS1 and OS2 and to be opened to the atmosphere. The second sealing units OS1 and OS2 according to the exemplary embodiment are, for example, oil seals and have a ring shaped structure. As indicated by an arrow A2 in FIG. 4, when the sealing of the second sealing unit OS1 is loosened, the quenching water flowing through the second flow passage FP2 leaks to the drain flow passage FP3-1. Similarly, when the sealing of the second sealing unit OS2 is loosened, the quenching water flowing through the second flow passage FP2 leaks to the drain flow passage FP3-2.

As described above, the rotary joint 26 has the rotary unit RR configured to rotate together with rotation of the head unit 1, the fixing units FR1 to FR4 provided around the rotary unit RR, and the sealing units MS1 to MS8 configured to seal a gap between the rotary unit RR and the fixing units FR1 to FR4. Further, the rotary joint 26 is formed with a first flow passage (main line) through which a gas passes, and a second flow passage (a quenching water line) which is isolated from the first flow passage (main line) by the sealing units MS1 to MS8. The quenching water passes through the second flow passage. Further, the rotary joint 26 further includes the second sealing units OS1 and OS2 which seal a gap between the quenching water and the atmosphere and drain flow passages FP3-1 and FP3-2 are formed which are isolated from the second flow passage by the second sealing units OS1 and OS2 and have outlet ports opened to the atmosphere.

As illustrated in FIG. 4, the inlet pipe IP communicates with the inlet port T1 of the second flow passage FP2 of the rotary joint 26, and the quenching water is supplied to the rotary joint 26 through the inlet pipe IP.

As illustrated in FIG. 4, one end of the outlet pipe OP communicates with the outlet port T2 of the second flow passage FP2 of the rotary joint 26 and the other end (opening) is opened to the atmosphere in a position lower than the outlet port T2 of the second flow passage FP2. That is, the outlet pipe OP is disposed below the outlet port T2 of the second flow passage FP2 of the rotary joint 26 and the other end (opening) of the outlet pipe OP is at an atmospheric pressure.

According to this configuration, water is filled between the outlet port T2 of the second flow passage FP2 of the rotary joint 26 and the other end of the outlet pipe OP opened to the atmosphere at the outlet port T2 of the second flow passage FP2 of the rotary joint 26 so that hydraulic head pressure corresponding to a height difference downwardly acts on the other end of the outlet pipe OP. Therefore, in the other end of the outlet pipe OP, the quenching water is sucked out at the hydraulic head pressure corresponding to the height difference. Thus, the pressure of the outlet port T2 of the second flow passage FP2 becomes lower than the pressure (i.e., the atmospheric pressure) of the other end of the outlet pipe OP by the hydraulic head pressure corresponding to the height difference so that the pressure of the second flow passage FP2 becomes lower than the atmospheric pressure. Therefore, since the pressure of the second flow passage FP2 becomes lower than the pressure of the first flow passage FP1, the pressure difference causes the quenching water to be held in the second flow passage. Therefore, a possibility of the leakage of the quenching water from the second flow passage FP2 to the first flow passage FP1 through the sealing units MS1 to MS8 may be lowered. Further, since the quenching water is sucked out from the outlet port T2, the flow rate of the quenching water line (second flow passage) of the rotary joint 26 may be secured even if the supply pressure of the quenching water toward the rotary joint 26 is lowered. As described above, the supply pressure of the quenching water toward the rotary joint 26 may be reduced, and even in this point of view, the possibility of leakage of the quenching water to the main line (first flow passage) in the rotary joint may be suppressed. Accordingly, the flow rate of the second flow passage FP2 of the rotary joint 26 can be secured while suppressing the possibility of the leakage to the first flow passage FP1 in the rotary joint 26.

The height difference Hout between the outlet port T2 of the second flow passage FP2 of the rotary joint 26 and the other end (opening) of the outlet pipe OP may be determined based on a suction pressure of the quenching water. Thus, the quenching water may be sucked out from the rotary joint 26 at a desired suction pressure.

Second Exemplary Embodiment

Subsequently, a second exemplary embodiment will be described. In order to continuously drive the substrate processing apparatus, it is required to secure a flow rate of the quenching water line (second flow passage) while limiting an increase in the pressure of the quenching water such that the quenching water does not leak to the main line. For example, there is a demand for supplying the quenching water to the rotary joint 26 at a 30 kPa or lower (for example, in the level of several kPa). The supply pressure of the quenching water is limited by reducing the flow rate to the rotary joint 26 by the throttle (orifice) OR. However, the supply pressure of the quenching water is affected by the pressure fluctuation of the quenching water supply source. Further, for example, in order to increase an injection pressure of washing water supplied from the quenching water supply source, the pressure of the quenching water supply source may be changed in some cases. Therefore, according to the present exemplary embodiment, in addition to the first exemplary embodiment, a branch pipe BP is provided at a quenching water supply side of the rotary joint 26 and one branch of the branch pipe BP upwardly extends so that the supply pressure of the quenching water to the rotary joint 26 may be limited.

Figure 5:
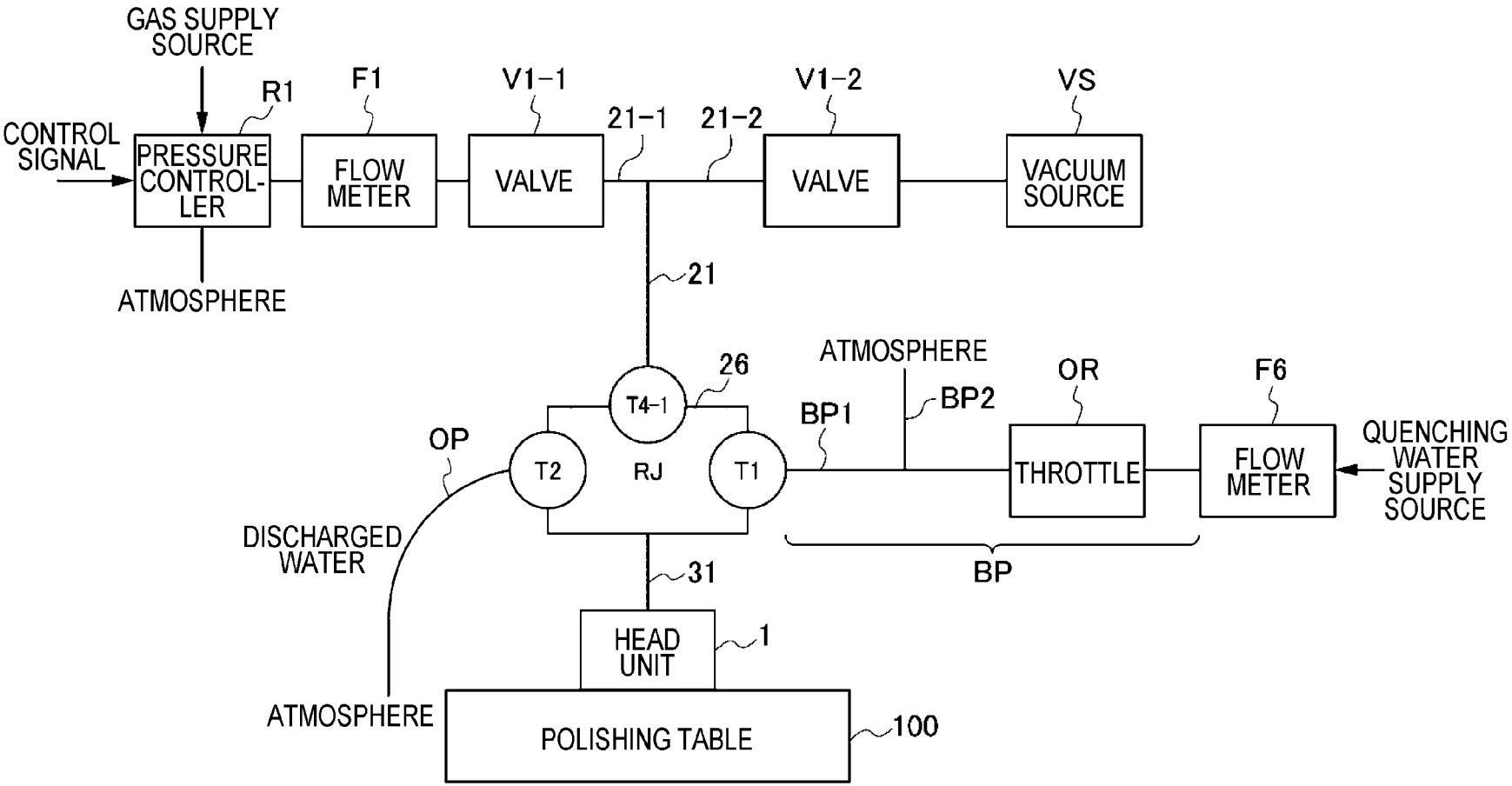
FIG. 5 is a schematic view illustrating a configuration of a part of a polishing apparatus according to a second exemplary embodiment.

FIG. 5 is a schematic view illustrating a configuration of a part of a polishing apparatus according to the second exemplary embodiment. The components of the polishing apparatus which are the same as those of the polishing apparatus according to the first exemplary embodiment of FIG. 3 will be denoted by the same reference numerals, and the descriptions thereof will be omitted.

The polishing apparatus according to the second exemplary embodiment of FIG. 5 is different from the polishing apparatus according to the first exemplary embodiment of FIG. 3 in that the inlet pipe IP is changed to a branch pipe BP.

Figure 6:
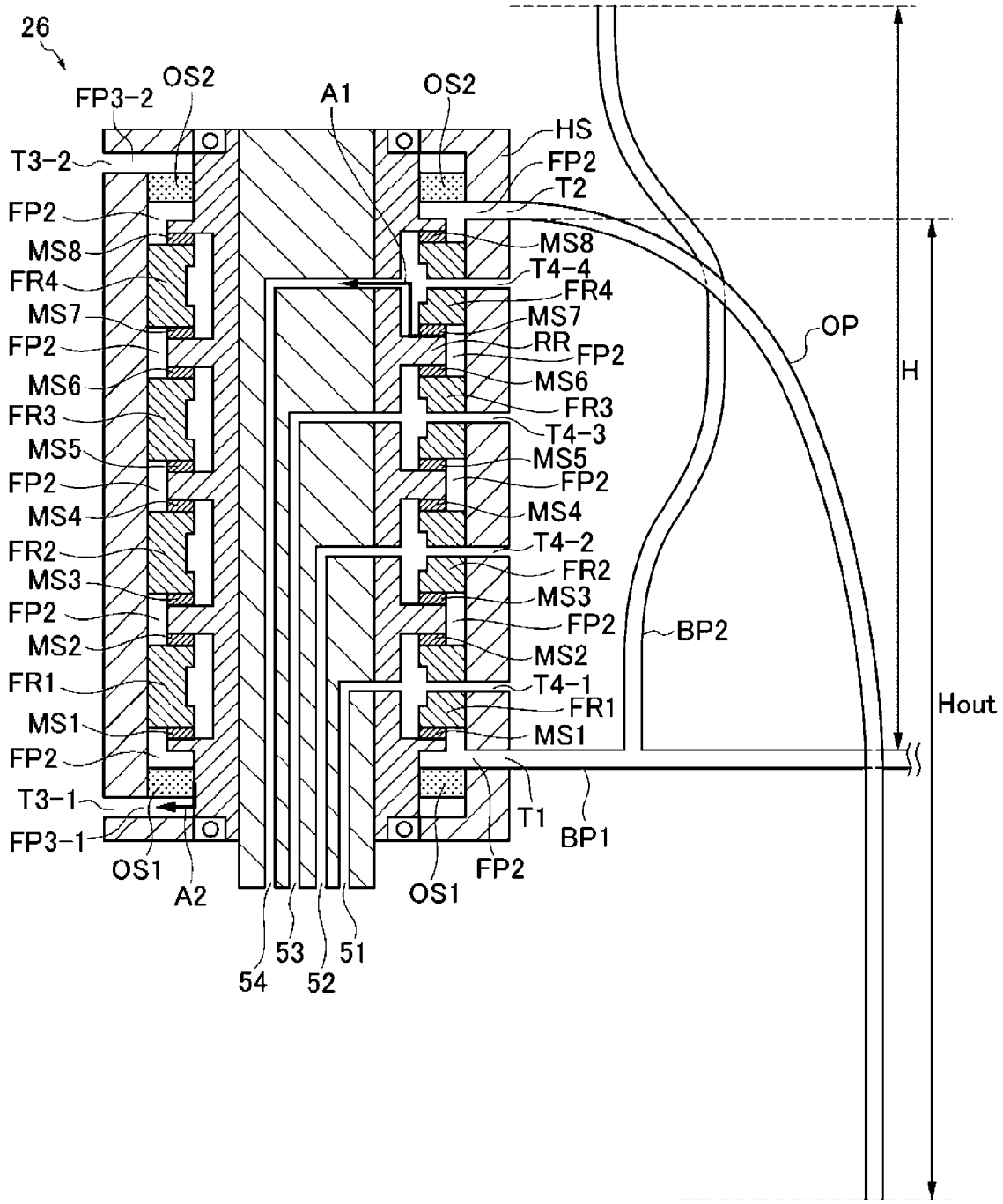
FIG. 6 is a schematic cross-sectional view illustrating an arrangement of an outlet pipe and a branch pipe according to a second exemplary embodiment.

FIG. 6 is a schematic cross-sectional view illustrating an arrangement of an outlet pipe and a branch pipe according to a second exemplary embodiment. As illustrated in FIG. 6, the branch pipe BP has an inlet port through which the quenching water is supplied and is divided into a first branch portion BP1 and a second branch portion BP2. An end of the first branch portion BP1 communicates with an inlet port T1 of the second flow passage FP2 of the rotary joint. In the meantime, the opening of the second branch portion BP2 is opened to the atmosphere at a position higher than the inlet port T1 of the second flow passage FP2. Specifically, the second branch portion BP2 extends to be higher than the inlet port T1 of the second flow passage FP2 and an end of the second branch portion BP2 is opened to the atmosphere.

Specifically, as illustrated in FIG. 6, a height difference between the opening of the second branch portion BP2 and the inlet port T1 of the second flow passage FP2 is set to be H. According to this configuration, a water surface in the second branch portion BP2 may rise to the opening of the second branch portion BP2. Even though the supply pressure of the quenching water from the inlet port increases to exceed a pressure corresponding to the height difference H, the quenching water overflows from the opening of the second branch portion BP2. Therefore, the water surface is constant and the pressure in the inlet port T1 of the second flow passage FP2 is maintained at a pressure corresponding to the height difference H. As described above, the pressure in the inlet port T1 of the second flow passage FP2 is restricted to a pressure corresponding to the height difference H. The supply pressure of the quenching water may be restricted to a pressure corresponding to the height difference of the opening of the second branch portion BP2 and the inlet port T1 of the second flow passage FP2.

The height difference between the opening of the second branch portion BP2 and the inlet port T1 of the second flow passage FP2 is determined based on a limit pressure which limits a pressure of the quenching water supplied to the second flow passage FP2. For example, when the pressure of the quenching water is limited to 5 kPa, the height difference H between the opening of the second branch portion BP2 and the inlet port T1 of the second flow passage FP2 is set to be 0.5 m. Thus, the pressure of the quenching water supplied to the second flow passage FP2 may be suppressed to be equal to or lower than the limit pressure.

Third Exemplary Embodiment

Figure 7:
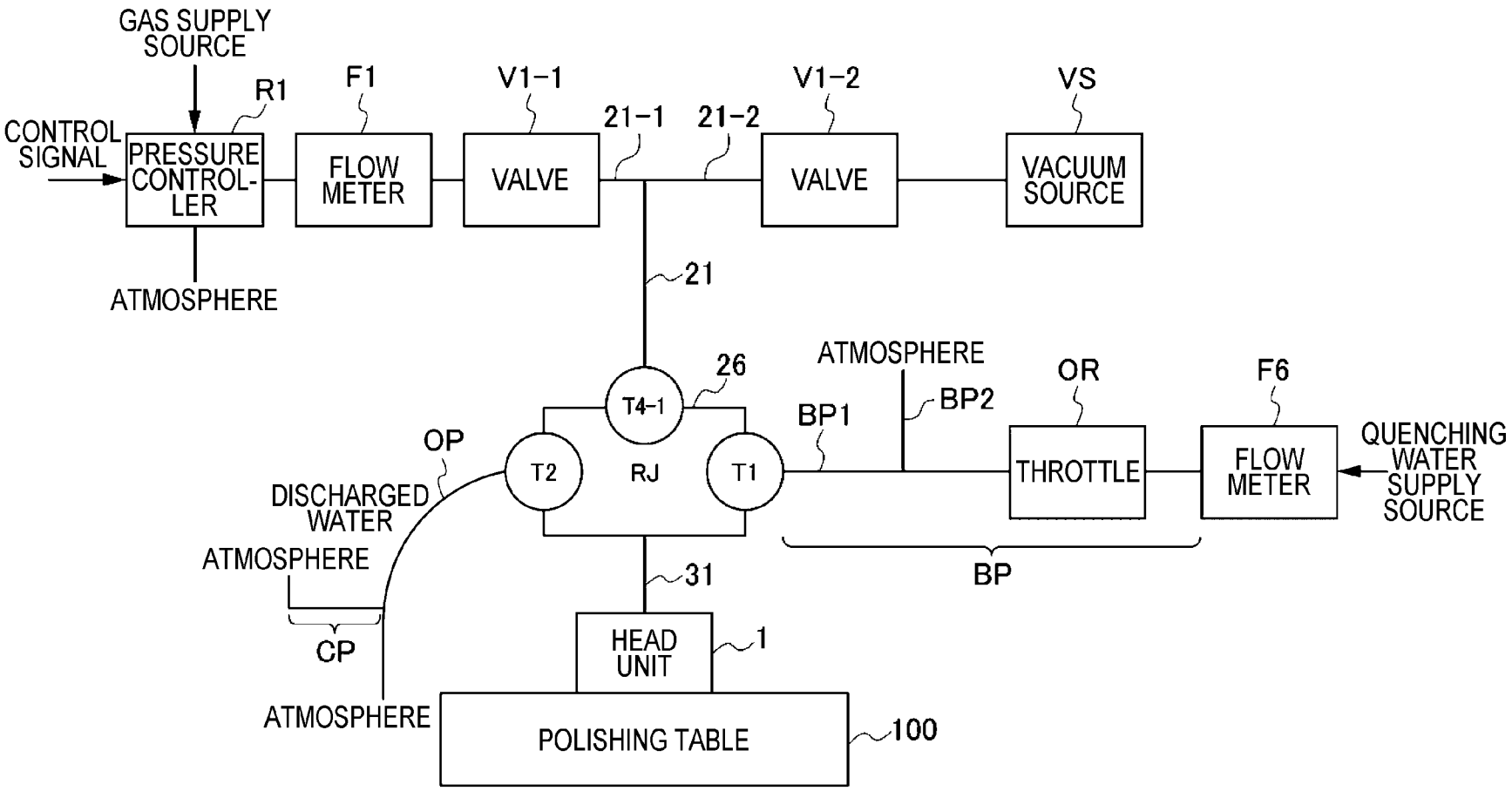
FIG. 7 is a schematic view illustrating a configuration of a part of a polishing apparatus according to a third exemplary embodiment.
Figure 8:
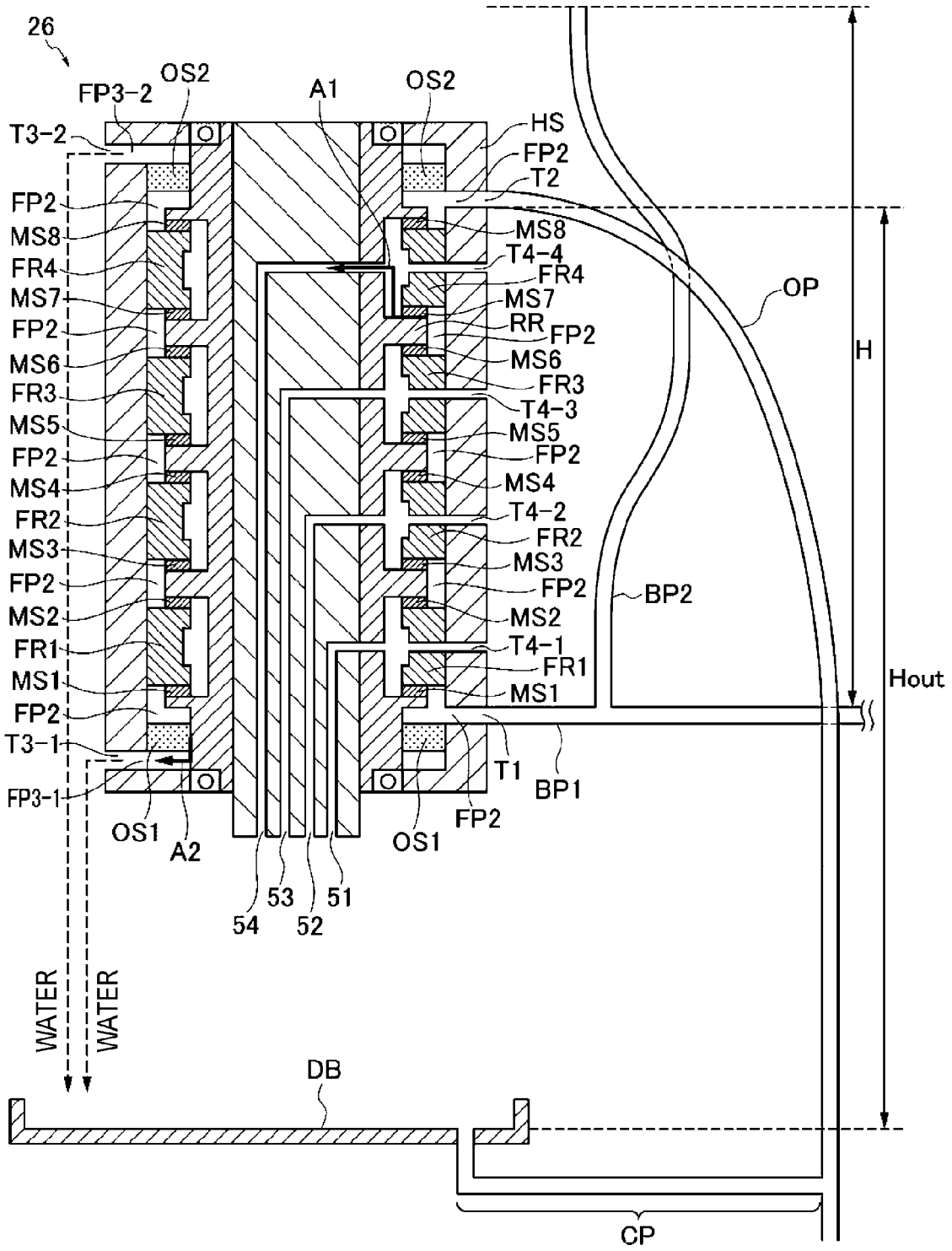
FIG. 8 is a schematic cross-sectional view illustrating an arrangement of an outlet pipe and a branch pipe according to a third exemplary embodiment.

Subsequently, a third exemplary embodiment will be described. FIG. 7 is a schematic view illustrating a configuration of a part of a polishing apparatus according to the third exemplary embodiment. The components of the polishing apparatus which are the same as those of the polishing apparatus according to the second exemplary embodiment of FIG. 5 will be denoted by the same reference numerals and the descriptions thereof will be omitted. FIG. 8 is a schematic cross-sectional view illustrating an arrangement of an outlet pipe and a branch pipe according to the third exemplary embodiment. A polishing apparatus 10 according to the third exemplary embodiment of FIG. 7 is different from the polishing apparatus 10 according to the second exemplary embodiment of FIG. 5 in that a connection pipe CP having one end opened to the atmosphere is connected to the outlet pipe OP.

Specifically, as illustrated in FIG. 8, the polishing apparatus 10 according to the third exemplary embodiment includes a drain board DB which is disposed to receive the quenching water leaking from the outlet port of the drain flow passage and has an outlet port that discharges the received quenching water. Further, the polishing apparatus 10 includes a connection pipe CP one end of which communicates with the outlet port of the drain board DB and the other end communicates with the outlet pipe OP. Further, the height of the outlet port of the drain board DB is determined based on the suction pressure of the quenching water.

Thus, the quenching water leaking from the second sealing units OS1 and OS2 may be discharged together with the normally discharged quenching water. Further, the quenching water may be sucked out at a desired suction pressure.

Fourth Exemplary Embodiment

Continuously, a fourth exemplary embodiment will be described. In the second and third exemplary embodiments, when the supply pressure of the deionized water from the inlet port of the branch pipe BP is lower than the suction pressure, the deionized water in the branch pipe BP may be exhausted, and air may be sucked into the second flow passage FP2 of the rotary joint 26. Therefore, in the present exemplary embodiment, the second branch portion BP2 is configured to upwardly extend after extending to be lower than the inlet port T1 of the second flow passage FP2 such that, even if the supply pressure of the deionized water from the inlet port of the branch pipe BP is lower than the suction pressure, the liquid surface is maintained at a position lower than the inlet port T1 of the second flow passage FP2 so that air is prevented from being sucked into the second flow passage FP2 of the rotary joint 26.

Figure 9:
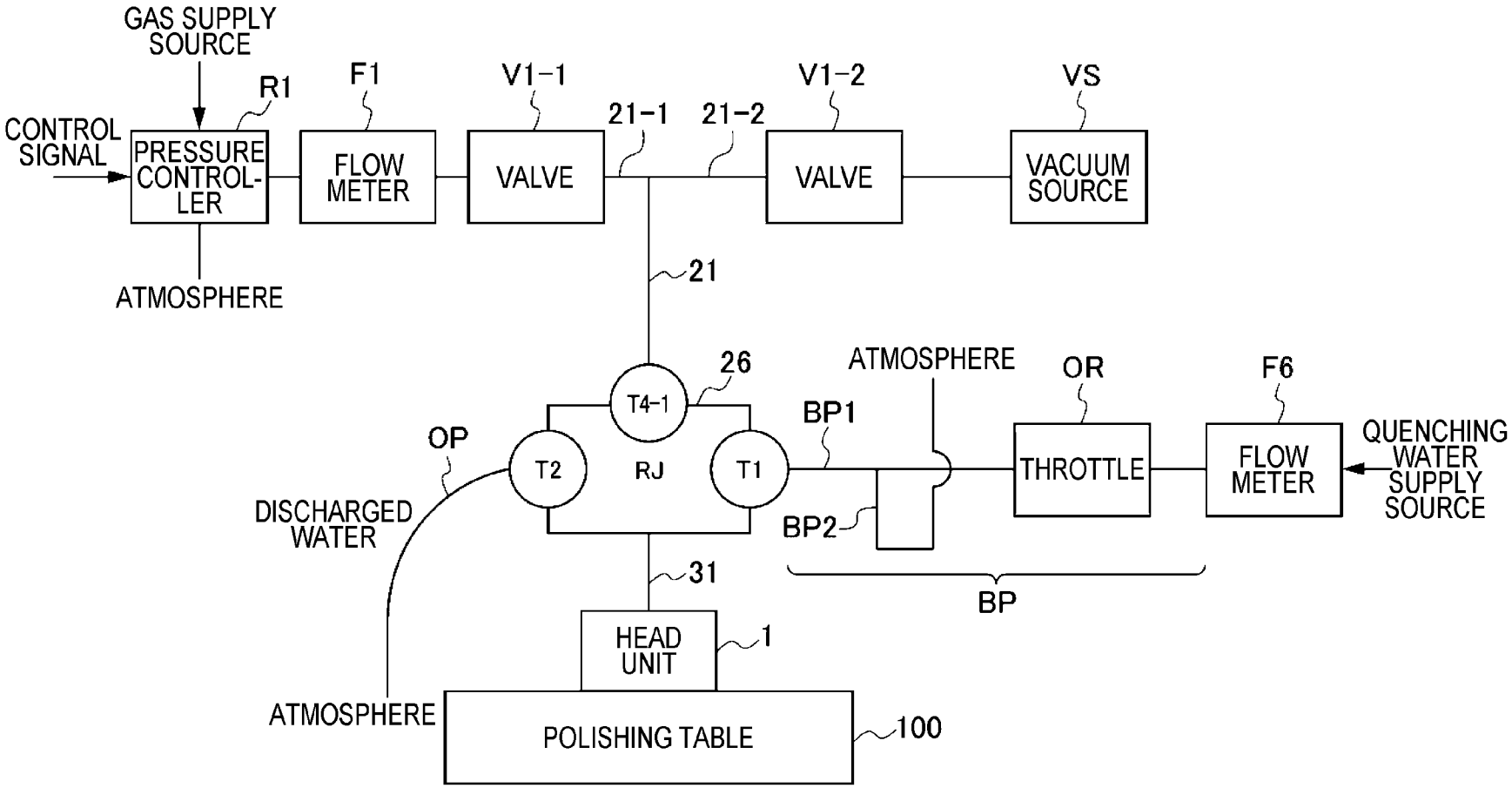
FIG. 9 is a schematic view illustrating a configuration of a part of a polishing apparatus according to a fourth exemplary embodiment.
Figure 10:
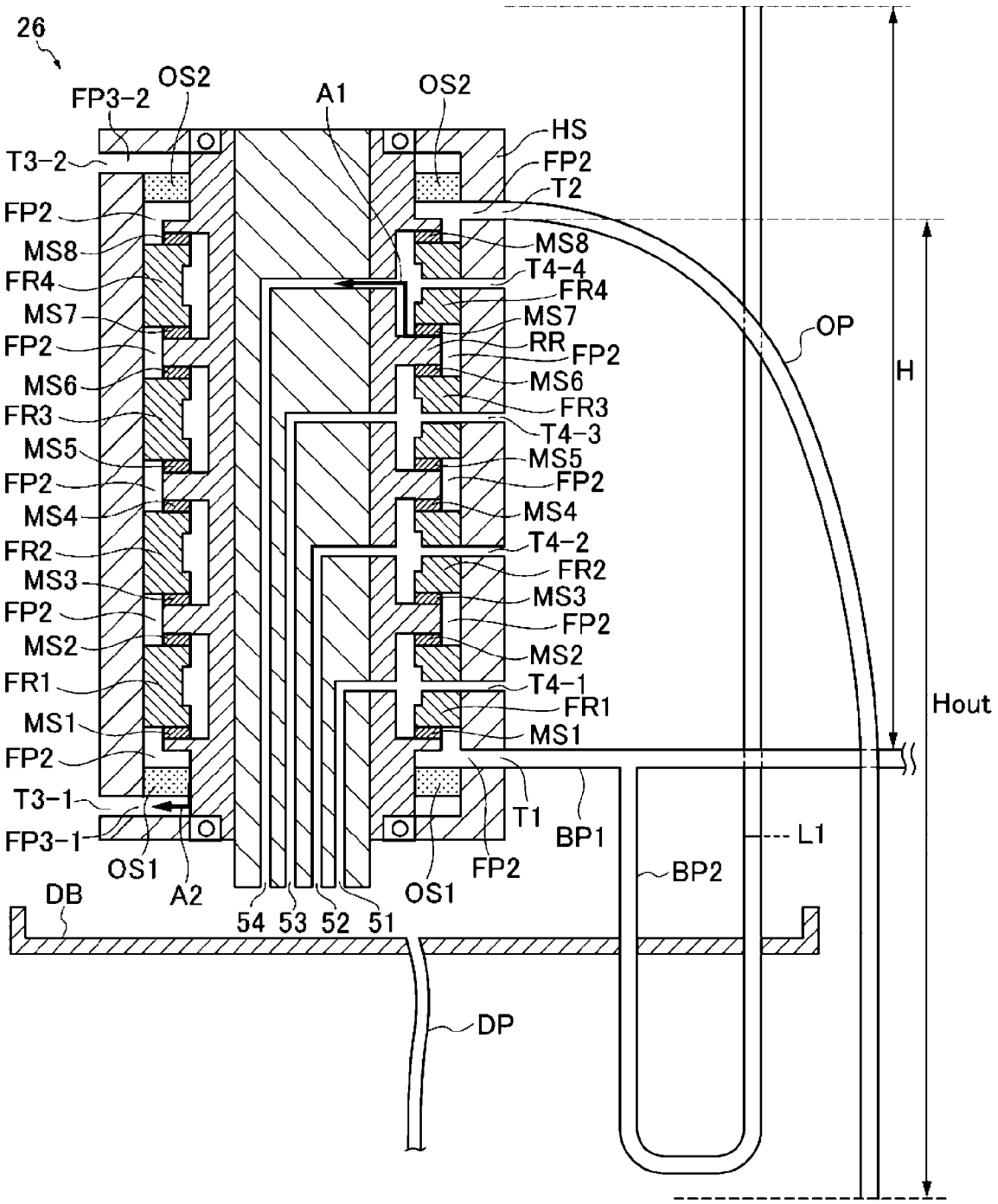
FIG. 10 is a schematic cross-sectional view illustrating an arrangement of an outlet pipe and a branch pipe according to a fourth exemplary embodiment.

FIG. 9 is a schematic view illustrating a configuration of a part of a polishing apparatus according to a fourth exemplary embodiment. The components of the polishing apparatus which are the same as those of the polishing apparatus according to the second exemplary embodiment of FIG. 5 are denoted by like reference numerals, and the descriptions thereof will be omitted. FIG. 10 is a schematic cross-sectional view illustrating an arrangement of an outlet pipe and a branch pipe according to the fourth exemplary embodiment. A polishing apparatus 10 according to the fourth exemplary embodiment of FIG. 9 is different from the polishing apparatus 10 according to the second exemplary embodiment of FIG. 5 in that the second branch portion BP2 upwardly extends after extending to be lower than the inlet port T1 of the second flow passage FP2.

Specifically, as illustrated in FIG. 10, the second branch portion BP2 upwardly extends after extending to be lower than the inlet port T1 of the second flow passage FP2 and an end of the second branch portion BP2 is opened to the atmosphere. As described in the first exemplary embodiment, the outlet pipe OP is disposed below the outlet port T2 of the second flow passage FP2 of the rotary joint 26 and the other end (opening) of the outlet pipe OP is under the atmospheric pressure, and therefore, the second flow passage FP2 has a negative pressure as compared to the atmospheric pressure. Therefore, when the supply pressure of the deionized water from the inlet port of the branch pipe BP is lower than the suction pressure, as represented by the liquid surface L1 of FIG. 10, the height of the liquid surface in the second branch portion BP2 is lower than the inlet port T1 of the second flow passage FP2. As described above, even though the supply pressure of the deionized water from the inlet port of the branch pipe BP is lower than the suction pressure, the second branch portion BP2 extends to be lower than the inlet port of the second flow passage. Therefore, the liquid surface may be maintained at a position lower than the inlet port T1 of the second flow passage FP2. Thus, the air may be prevented from being sucked into the second flow passage FP2 of the rotary joint 26.

The second branch portion BP2 has transparency. Therefore, the position of the liquid surface in the pipe of the second branch portion BP2 may be identified so that the current pressure of the quenching water may be visually noticed.

As illustrated in FIG. 10, the polishing apparatus 10 according to the fourth exemplary embodiment further includes a drain board DB which is disposed to receive the quenching water leaking from the end of the second branch portion BP2 and has an outlet port that discharges the received quenching water. The outlet port communicates with a drain pipe DP and the quenching water is discharged through the drain pipe DP. Thus, the leaking quenching water may be discharged to a desired discharge place. Further, the drain board DB is disposed to receive quenching water leaking from the outlet port of the drain flow passage. Thus, the quenching water leaking from the second sealing units OS1 and OS2 may be discharged together with the normally discharged quenching water.

Fifth Exemplary Embodiment

Figure 11:
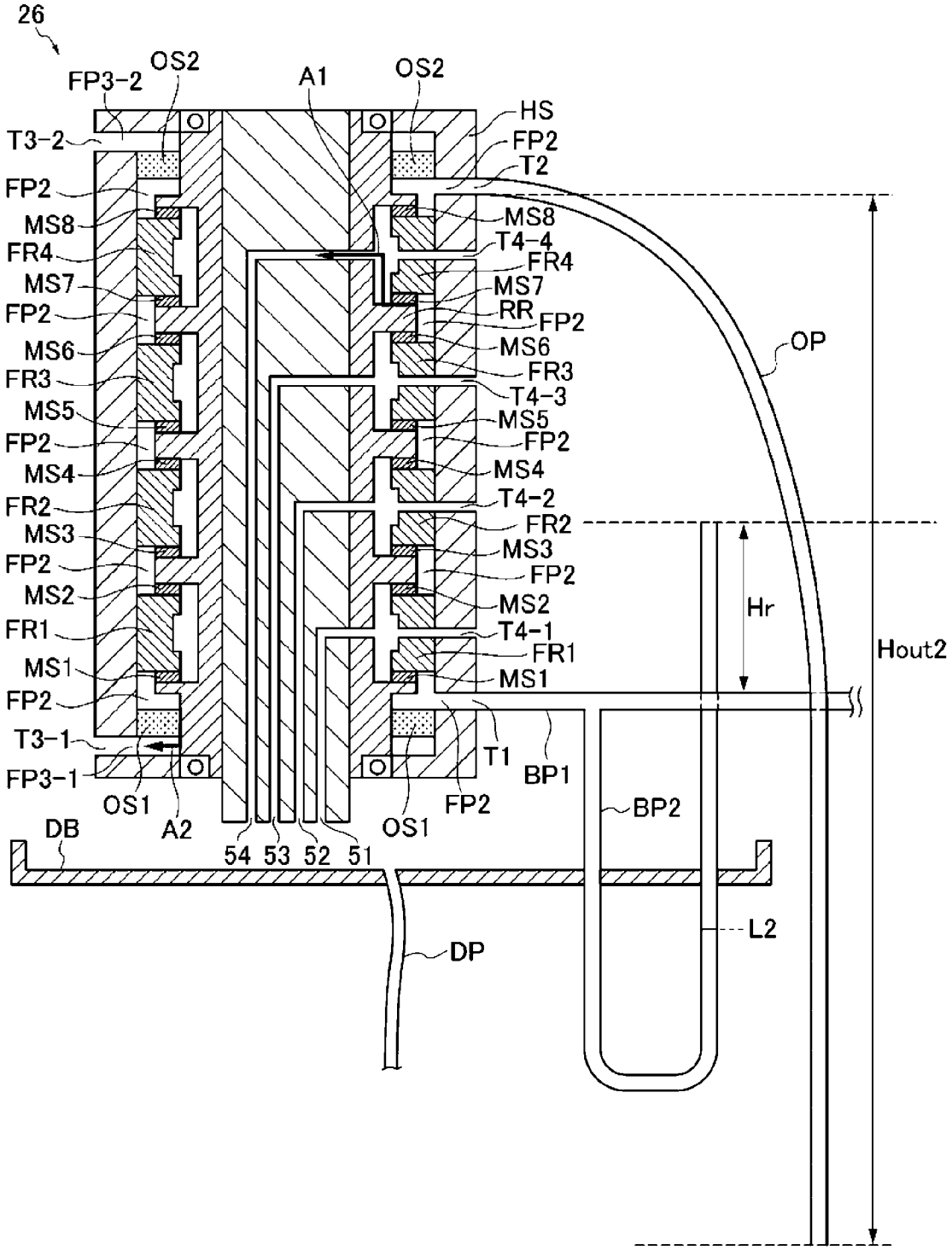
FIG. 11 is a schematic cross-sectional view illustrating an arrangement of an outlet pipe and a branch pipe according to a fifth exemplary embodiment.

Continuously, a fifth exemplary embodiment will be described. FIG. 11 is a schematic cross-sectional view illustrating an arrangement of an outlet pipe and a branch pipe according to a fifth exemplary embodiment. A polishing apparatus 10 according to a fifth exemplary embodiment of FIG. 11 is different from the polishing apparatus 10 according to the fourth exemplary embodiment of FIG. 10 in that a difference in heights from the outlet port T2 of the second flow passage FP2 of the rotary joint to the opening of the outlet pipe OP is increased from Hout to Hout2 (Hout<Hout2) and a difference in heights of the end of the second branch portion BP2 with respect to the inlet port T1 of the second flow passage FP2 is decreased from H to Hr (H>Hr). In the meantime, the polishing apparatus 10 according to the fifth exemplary embodiment is similar to the polishing apparatus according to the fourth exemplary embodiment other than the above description, so that a schematic view illustrating a configuration of a part of the polishing apparatus according to the fifth exemplary embodiment will be omitted.

Thus, as represented by the liquid surface L2 of FIG. 11, normally, the height of the liquid surface in the second branch portion BP2 is lower than the inlet port T1 of the second flow passage FP2. That is, the height difference Hout2 from the outlet port T2 of the second flow passage FP2 of the rotary joint to the opening of the outlet pipe OP and the pressure of the quenching water which flows into the branch pipe BP are adjusted so as to maintain the height of the liquid surface of the quenching water in the second branch portion BP2 to be lower than the inlet port T1 of the second flow passage FP2 regardless of a predetermined amount of pressure fluctuation. Thus, since the second flow passage FP2 of the rotary joint has always a negative pressure as compared to the atmospheric pressure, the second flow passage FP2 has always a negative pressure as compared to that in the first flow passage FP1. Therefore, the pressure difference always acts to maintain the quenching water in the second flow passage FP2 so that the quenching water may be prevented from leaking from the second flow passage FP2 to the first flow passage FP1 through the sealing units MS1 to MS8.

In the meantime, even if the pressure of the quenching water flowing in the branch pipe BP is increased due to a certain factor, the supply pressure of the quenching water may be limited to a pressure corresponding to a height difference Hr of the end of the second branch portion BP2 with respect to the inlet port T1 of the second flow passage FP2. Thus, as compared with the fourth exemplary embodiment, according to the fifth exemplary embodiment, an upper limit pressure of the supply pressure of the quenching water may be lowered.

In the meantime, similarly to the fourth exemplary embodiment, also in the fifth exemplary embodiment, the second branch portion BP2 has transparency. Therefore, the position of the liquid surface in the pipe of the second branch portion BP2 may be identified so that the current pressure of the quenching water may be visually noticed.

Sixth Exemplary Embodiment

Figure 12:
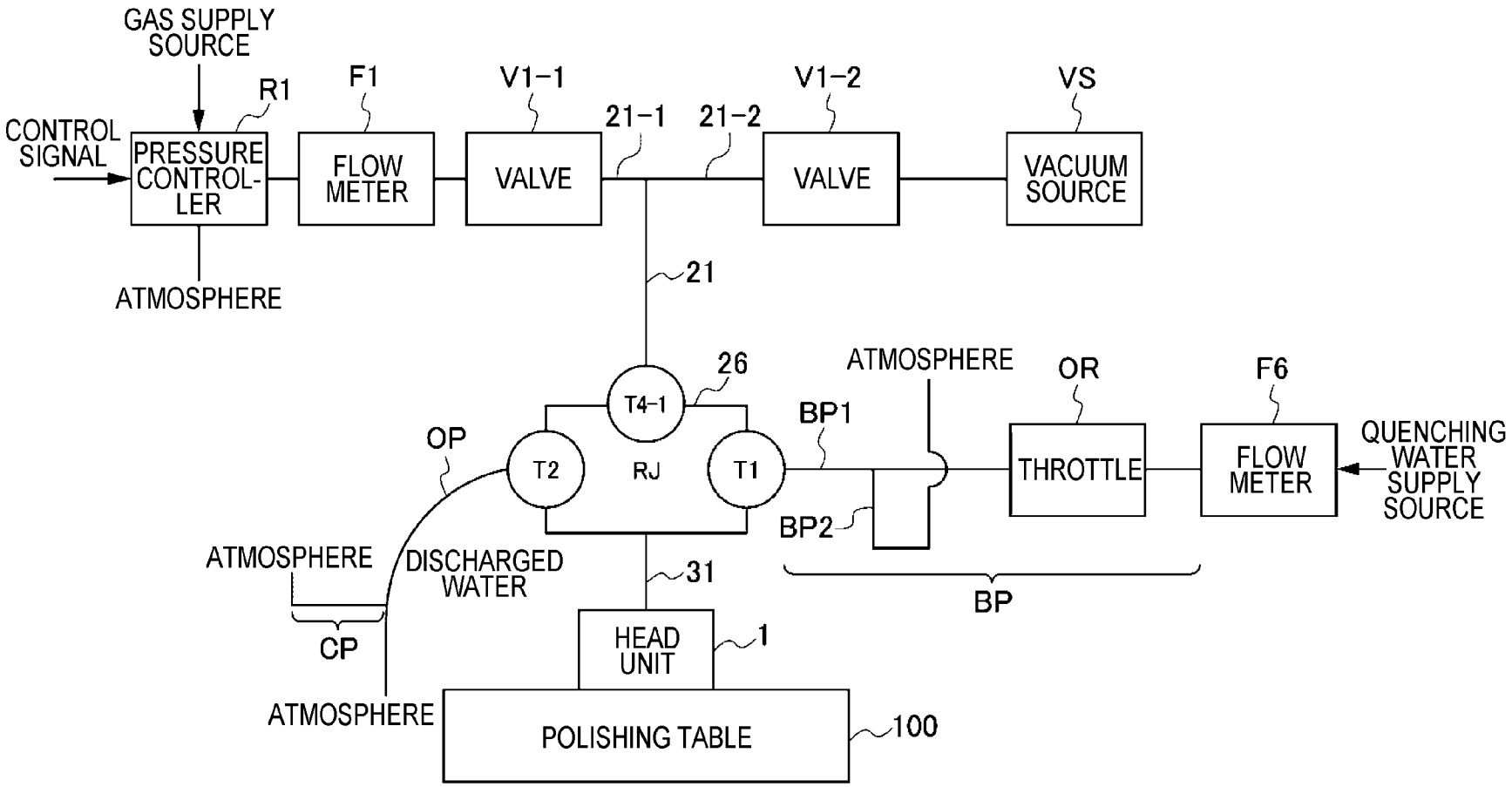
FIG. 12 is a schematic view illustrating a configuration of a part of a polishing apparatus according to a sixth exemplary embodiment.
Figure 13:
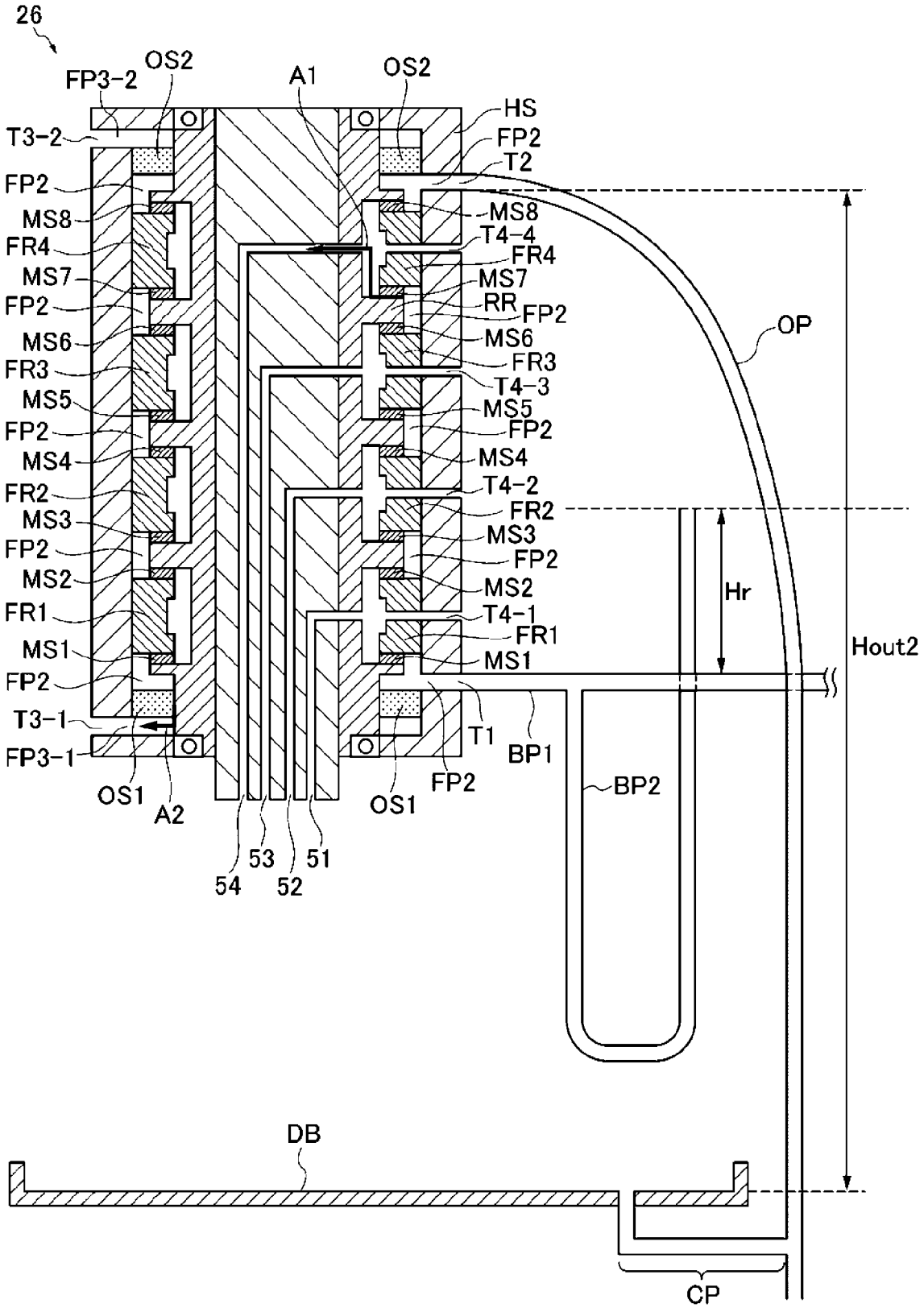
FIG. 13 is a schematic cross-sectional view illustrating an arrangement of an outlet pipe and a branch pipe according to a sixth exemplary embodiment.

Subsequently, a sixth exemplary embodiment will be described. FIG. 12 is a schematic view illustrating a configuration of a part of a polishing apparatus according to the sixth exemplary embodiment. The components of the polishing apparatus, which are the same as those of the polishing apparatus according to the fourth exemplary embodiment of FIG. 9, are denoted by the same reference numerals and the descriptions thereof will be omitted. FIG. 13 is a schematic cross-sectional view illustrating an arrangement of an outlet pipe and a branch pipe according to the sixth exemplary embodiment. A polishing apparatus 10 according to the sixth exemplary embodiment of FIG. 12 is different from the polishing apparatus 10 according to the fifth exemplary embodiment in that a connection pipe CP having one end opened to the atmosphere is connected to the outlet pipe OP.

Specifically, as compared with the polishing apparatus 10 according to the fifth exemplary embodiment of FIG. 11, the polishing apparatus 10 according to the sixth exemplary embodiment of FIG. 13 further includes a drain board which is disposed to receive the quenching water leaking from the opening of the second branch portion BP2 and has an outlet port that discharges the received quenching water. Further, the polishing apparatus 10 according to the sixth exemplary embodiment includes a connection pipe CP one end of which communicates with the outlet port of the drain board and the other end communicates with the outlet pipe. Further, the height of the outlet port of the drain board DB is determined based on a suction pressure of the quenching water. Thus, the quenching water leaking from the opening of the second branch portion BP2 may be discharged together with the normally discharged quenching water. Further, the quenching water may be sucked out at a desired suction pressure.

The drain board is disposed to receive the quenching water leaking from the outlet port of the drain flow passage of the rotary joint 26. Thus, the quenching water leaking from the second sealing units OS1 and OS2 may be discharged together with the normally discharged quenching water.

In the meantime, similarly to the polishing apparatus 10 according to the fifth exemplary embodiment of FIG. 11, in the polishing apparatus 10 according to the sixth exemplary embodiment of FIG. 13, a height difference of the end of the second branch portion BP2 with respect to the inlet port T1 of the second flow passage FP2 is decreased from H to Hr as compared with the fourth exemplary embodiment. Thus, according to the sixth exemplary embodiment, an upper limit pressure of the supply pressure of the quenching water may be lowered as compared with the fourth exemplary embodiment.

In the meantime, similarly to the fourth exemplary embodiment, the second branch portion BP2 also has transparency in the sixth exemplary embodiment. Therefore, the position of the liquid surface in the pipe of the second branch portion BP2 may be identified so that the current pressure of the quenching water may be visually noticed.

Seventh Exemplary Embodiment

Subsequently, a seventh exemplary embodiment will be described. In order to continuously drive the substrate processing apparatus, it is required to secure a flow rate of the quenching water line (second flow passage) while limiting the pressure increase of the quenching water such that the quenching water does not leak to the main line. For example, there is a demand for supplying the quenching water to the rotary joint 26 at a 30 kPa or lower (for example, in the level of several kPa). The supply pressure of the quenching water is limited by reducing the flow rate to the rotary joint 26 by the throttle (orifice) OR. However, the supply pressure of the quenching water is affected by the pressure fluctuation of the quenching water supply source. Further, for example, in order to increase the injection pressure of washing water supplied from the quenching water supply source, the pressure of the quenching water supply source may be changed in some cases. Therefore, according to the exemplary embodiment, a branch pipe BP is provided at a quenching water supply side of the rotary joint 26 and one branch of the branch pipe BP upwardly extends so that the supply pressure of the quenching water to the rotary joint 26 may be limited.

Figure 14:
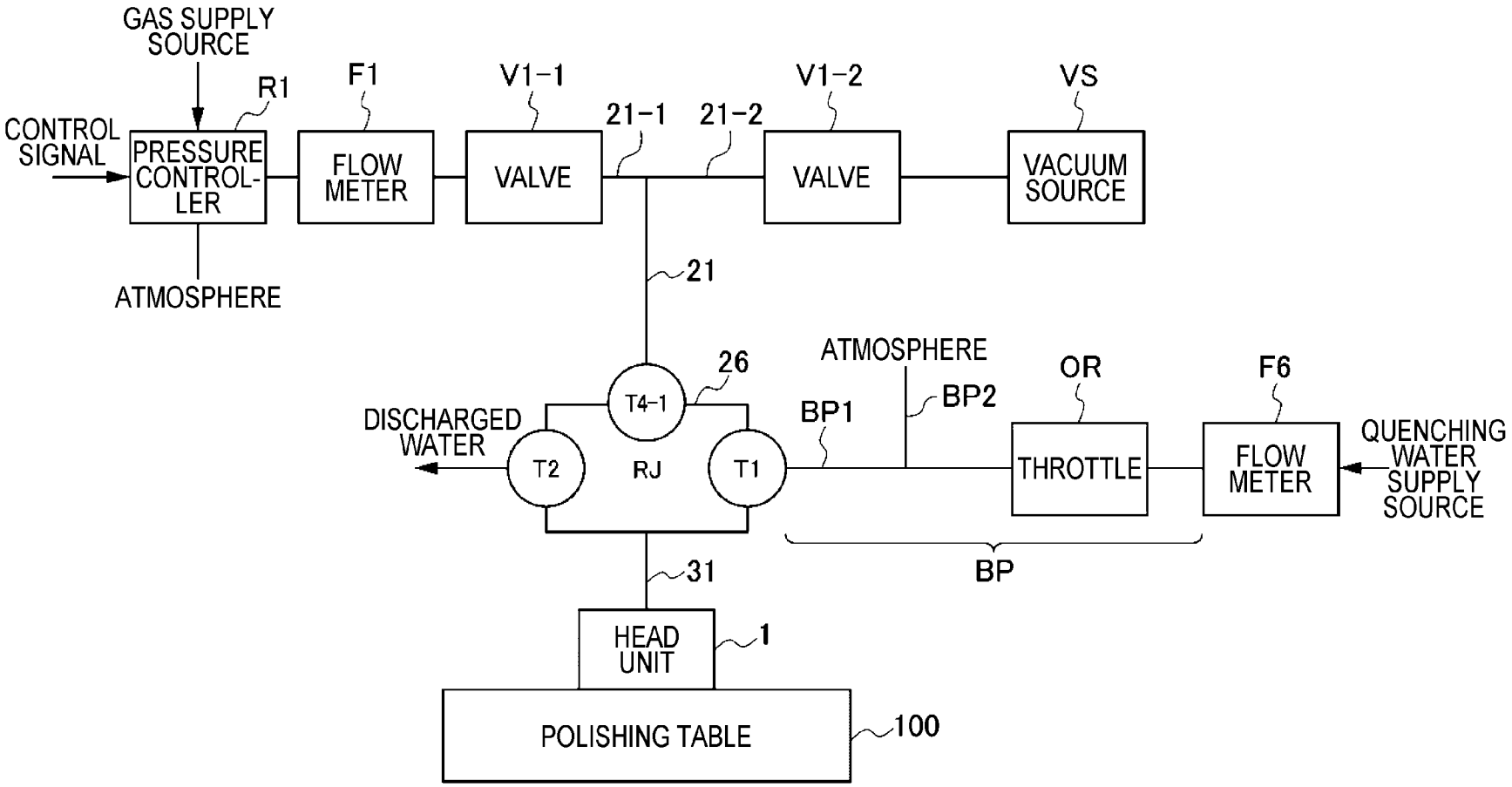
FIG. 14 is a schematic view illustrating a configuration of a part of a polishing apparatus according to a seventh exemplary embodiment.
Figure 15:
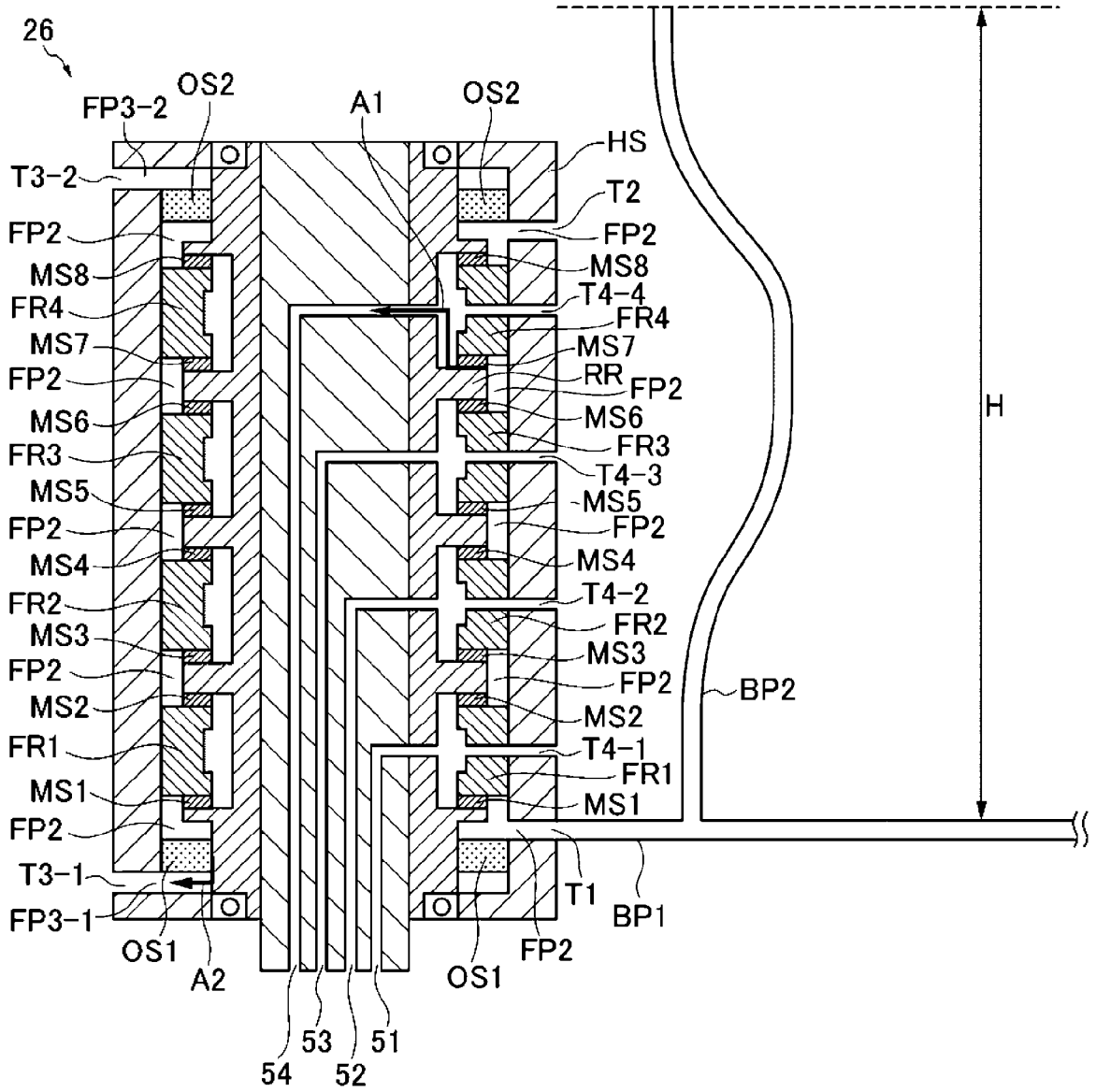
FIG. 15 is a schematic cross-sectional view illustrating an arrangement of an outlet pipe and a branch pipe according to a seventh exemplary embodiment.

FIG. 14 is a schematic view illustrating a configuration of a part of a polishing apparatus according to a seventh exemplary embodiment. The components of the polishing apparatus, which are the same as those of the polishing apparatus according to the second exemplary embodiment of FIG. 5, are denoted by same reference numerals and the descriptions thereof will be omitted. FIG. 15 is a schematic cross-sectional view illustrating an arrangement of an outlet pipe and a branch pipe according to the seventh exemplary embodiment. A polishing apparatus 10 according to the seventh exemplary embodiment of FIG. 14 is different from the polishing apparatus 10 according to the second exemplary embodiment of FIG. 5 in that the outlet pipe OP is not provided.

As illustrated in FIG. 15, the branch pipe BP has an inlet port through which the quenching water is supplied and is divided into a first branch portion BP1 and a second branch portion BP2. An end of the first branch portion BP1 communicates with an inlet port T1 of the second flow passage FP2 of the rotary joint. In the meantime, the opening of the second branch portion BP2 is opened to the atmosphere at a position higher than the inlet port T1 of the second flow passage FP2. Specifically, the second branch portion BP2 extends to be higher than the inlet port T1 of the second flow passage FP2 and an end of the second branch portion BP2 is opened to the atmosphere.

Specifically, as illustrated in FIG. 15, a height difference between the opening of the second branch portion BP2 and the inlet port T1 of the second flow passage FP2 is set to be H. According to this configuration, a water surface in the second branch portion BP2 may rise to the opening of the second branch portion BP2. Even if the supply pressure of the quenching water from the inlet port increases to exceed a pressure corresponding to the height difference H, the quenching water overflows from the opening of the second branch portion BP2. Therefore, the water surface is constant and the pressure in the inlet port T1 of the second flow passage FP2 is maintained at a pressure corresponding to the height difference H. As described above, the pressure in the inlet port T1 of the second flow passage FP2 is limited to a pressure corresponding to the height difference H. The supply pressure of the quenching water may be restricted to a pressure corresponding to the height difference between the opening of the second branch portion BP2 and the inlet port T1 of the second flow passage FP2.

The height difference between the opening of the second branch portion BP2 and the inlet port T1 of the second flow passage FP2 is determined based on a limit pressure which limits the pressure of the quenching water supplied to the second flow passage FP2. For example, when the pressure of the quenching water is limited to 5 kPa, the height difference H between the opening of the second branch portion BP2 and the inlet port T1 of the second flow passage FP2 is set to be 0.5 m. Thus, the pressure of the quenching water supplied to the second flow passage FP2 may be suppressed to be equal to or lower than the limit pressure.

Eighth Exemplary Embodiment

Figure 16:
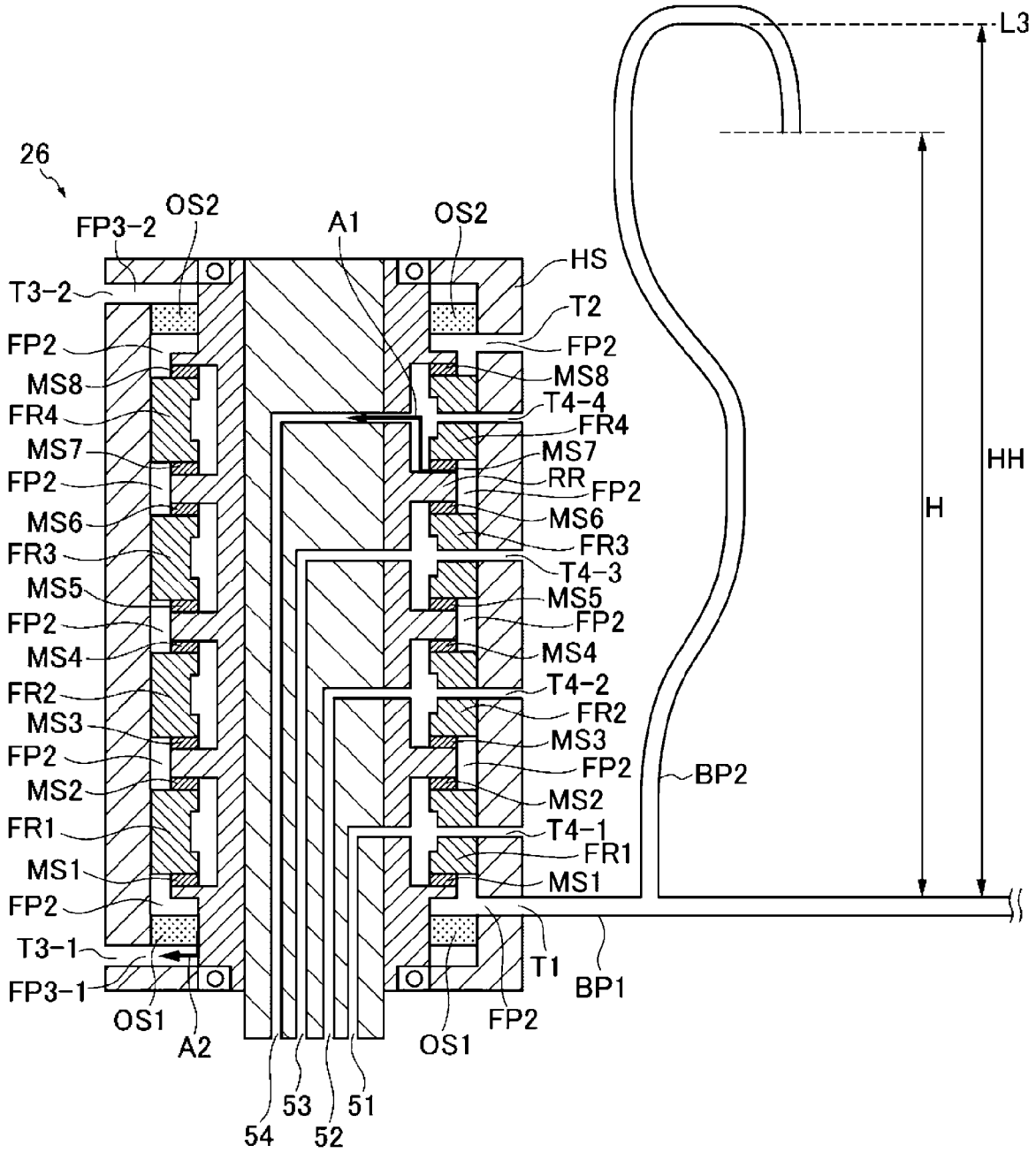
FIG. 16 is a schematic cross-sectional view illustrating an arrangement of an outlet pipe and a branch pipe according to an eighth exemplary embodiment.

Subsequently, an eighth exemplary embodiment will be described. FIG. 16 is a schematic cross-sectional view illustrating an arrangement of an outlet pipe and a branch pipe according to the eighth exemplary embodiment. A polishing apparatus 10 according to the eighth exemplary embodiment of FIG. 16 is different from the polishing apparatus 10 according to the seventh exemplary embodiment of FIG. 15 in that the second branch portion BP2 has an inverted U shape and downwardly extends after extending to be higher than the inlet port T1 of the second flow passage FP2. Thus, it is possible to prevent the quenching water from being upwardly sucked out.

Specifically, as illustrated in FIG. 16, for example, the second branch portion BP2 has an inverted U shape in which the second branch portion BP2 upwardly extends up to the height difference HH with reference to the inlet port T1 of the second flow passage FP2 and then downwardly extends to a position where the height difference becomes H. Thus, it is possible to set the supply pressure of the quenching water to a pressure (an allowable pressure) corresponding to the height difference HH. Further, when the pressure supplied from the inlet port exceeds the pressure corresponding to the height difference HH, the water surface exceeds the height L1 represented in FIG. 16. Therefore, the water is discharged from the opening of the second branch portion BP2. Further, the supply pressure of the quenching water is a pressure (limit pressure) corresponding to the height difference H so that the quenching water is continuously supplied to the rotary joint 26.

As described above, a difference between the highest position of the second branch portion BP2 and the inlet port T1 of the second flow passage FP2 is determined based on an allowable pressure which is allowed to the quenching water supplied to the second flow passage FP2. Further, when the pressure of the quenching water exceeds the allowable pressure, the height difference between the opening of the second branch portion BP2 and the inlet port T1 of the second flow passage FP2 is determined based on a maintained limit pressure.

Thus, normally, the pressure of the quenching water is suppressed to be equal to or lower than the allowable pressure and when the pressure of the quenching water exceeds the allowable pressure, the pressure of the quenching water is maintained at the limit pressure.

In the meantime, the second branch portion BP2 has an inverted U shape as an example, but the shape is not limited thereto. Corners thereof may not be round and the branch portion may downwardly extend after extending to be higher than the inlet port T1 of the second flow passage FP2.

In the meantime, the flow meter F6 is disposed to be closer to the quenching water supply source side than the throttle OR, but is not limited thereto. In any exemplary embodiment, the flow meter F6 may be disposed between the throttle OR and the branch pipe BP (or the inlet pipe IP). Alternatively, the flow meter F6 may be disposed between the branch pipe BP (or the inlet pipe IP) and the inlet port T1 of the second flow passage FP2 of the rotary joint 26. Alternatively, the flow meter F6 may be disposed between the outlet port outlet pipe of the second flow passage FP2 of the rotary joint 26 and the end of the outlet pipe at the atmosphere. When the flow meter F6 is disposed between the outlet port T2 of the second flow passage FP2 of the rotary joint 26 and the end of the discharge pipe at the atmosphere, the flow meter F6 may be an ultrasonic flow meter which has a low flow resistance.

In the fourth to sixth exemplary embodiments, it has been described that the second branch portion BP2 has transparency. However, even in the second, third, seventh, and eight exemplary embodiments, the second branch portion BP2 may also have transparency. Further, even in the second to seventh exemplary embodiments, the second branch portion BP2 may downwardly extend after extending to be higher than the inlet port T1 of the second flow passage FP2 and, for example, may have an inverted U shape.

From the foregoing, it will be appreciated that various exemplary embodiments of the present disclosure have been described herein for the purpose of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A substrate processing apparatus comprising:

a rotary joint including a rotor configured to rotate together with the rotation of a top ring, a stator radially surrounding the rotor, a first seal configured to seal a gap between the rotor and the stator, a first flow passage embedded within rotor and configured to allow a gas to pass therethrough, and a second flow passage passing through the stator and configured to allow quenching water to pass therethrough, the second flow passage being isolated from the first flow passage by the first seal; and an outlet pipe configured to discharge the quenching water, and having a first end configured to communicate with an outlet port of the second flow passage of the rotary joint at one end and a second end opened to atmosphere at a position lower than the outlet port of the second flow passage.

2. The substrate processing apparatus of claim 1, further comprising:

a branch pipe having an inlet port through which the quenching water is supplied and divided into a first branch portion and a second branch portion, wherein an end of the first branch portion communicates with an inlet port of the second flow passage of the rotary joint and an opening of the second branch portion is opened to the atmosphere at a position higher than the inlet port of the second flow passage.

3. The substrate processing apparatus of claim 2, wherein the second branch portion extends in a direction lower than the inlet port of the second flow passage and then upwardly extends, and the opening of the second branch portion is opened to the atmosphere.

4. The substrate processing apparatus of claim 3, wherein a height difference from the outlet port of the second flow passage of the rotary joint to the opening of the outlet pipe and the pressure of the quenching water flowing into the branch pipe are adjusted such that a height of a liquid surface of the quenching water in the second branch portion is maintained to be lower than the inlet port of the second flow passage regardless of a predetermined pressure fluctuation.

5. The substrate processing apparatus of claim 2, wherein a height difference between the opening of the second branch portion and the inlet port of the second flow passage is determined based on a limit pressure that limits the pressure of the quenching water supplied to the second flow passage.

6. The substrate processing apparatus of claim 2, wherein the second branch portion has transparency.

7. The substrate processing apparatus of claim 2, further comprising:

a drain board disposed to receive the quenching water leaking from the opening of the second branch portion, and having an outlet port that discharges the received quenching water.

8. The substrate processing apparatus of claim 2, further comprising:

a drain board disposed to receive the quenching water leaking from the opening of the second branch portion and having an outlet port that discharges the received quenching water; and a connection pipe having one end which communicates with the outlet port of the drain board and the other end communicates with the outlet pipe, wherein a height of the outlet port of the drain board is determined based on the suction pressure of the quenching water.

9. The substrate processing apparatus of claim 1, wherein a height difference between the outlet port of the second flow passage of the rotary joint and the other end of the outlet pipe is determined based on a suction pressure of the quenching water.

10. The substrate processing apparatus of claim 8, wherein the rotary joint further includes a second seal that seals a gap between the quenching water and the atmosphere and a drain flow passage isolated from the second flow passage and having an outlet port opened to the atmosphere is formed by the second seal, and the drain board is also disposed to receive the quenching water leaking from the outlet port of the drain flow passage.

11. The substrate processing apparatus of claim 1, wherein the rotary joint further includes a second seal that seals a gap between the quenching water and the atmosphere and a drain flow passage isolated from the second flow passage and having an outlet port opened to the atmosphere is formed by the second seal, and the substrate processing apparatus further includes:

a drain board disposed to receive the quenching water leaking from the opening of the second branch portion and having an outlet port that discharges the received quenching water; and a connection pipe having one end which communicates with the outlet port of the drain board and the other end communicates with the outlet pipe, wherein a height of the outlet port of the drain board is determined based on the suction pressure of the quenching water.

12. A substrate processing apparatus comprising:

a rotary joint including a rotor configured to rotate together with the rotation of a top ring, a stator radially surrounding the rotor, a seal configured to seal a gap between the rotor and the stator, a first flow passage embedded within the rotor and configured to allow a gas to pass therethrough, and a second flow passage passing through the stator and configured to allow quenching water to pass therethrough, the second flow passage being isolated from the first flow passage by the seal; and a branch pipe having an inlet port through which the quenching water is supplied and divided into a first branch portion and a second branch portion, wherein an end of the first branch portion communicates with an inlet port of the second flow passage of the rotary joint and an opening of the second branch portion is opened to the atmosphere at a position higher than the inlet port of the second flow passage.

13. The substrate processing apparatus of claim 12, wherein a height difference between the opening of the second branch portion and the inlet port of the second flow passage is determined based on a limit pressure that is limited when the quenching water is supplied.

14. The substrate processing apparatus of claim 12, wherein the second branch portion extends in a direction higher than the inlet port of the second flow passage and then downwardly extends.

15. The substrate processing apparatus of claim 14, wherein a height difference between the highest position of the second branch portion and the inlet port of the second flow passage is determined based on an allowable pressure of the quenching water that is allowed for supply to the second flow passage, and a height difference between the opening of the second branch portion and the inlet port of the second flow passage is determined based on the limit pressure maintained when a pressure of the quenching water exceeds the allowable pressure.

* * * * *